US009170041B2

(12) United States Patent
Dodson

(10) Patent No.: US 9,170,041 B2
(45) Date of Patent: Oct. 27, 2015

(54) SINGLE AND MULTI-STEP SNOWMAKING GUNS

(71) Applicant: Mitchell Joe Dodson, Park City, UT (US)

(72) Inventor: Mitchell Joe Dodson, Park City, UT (US)

( * ) Notice: Subject to any disclaimer, the term of this patent is extended or adjusted under 35 U.S.C. 154(b) by 0 days.

(21) Appl. No.: 14/014,330

(22) Filed: Aug. 29, 2013

(65) Prior Publication Data

US 2014/0166773 A1 Jun. 19, 2014

Related U.S. Application Data

(60) Provisional application No. 61/694,255, filed on Aug. 29, 2012, provisional application No. 61/694,250, filed on Aug. 29, 2012, provisional application No. 61/694,256, filed on Aug. 29, 2012, provisional application No. 61/694,262, filed on Aug. 29, 2012.

(51) Int. Cl.

| | |
|---|---|
| ***F25C 3/04*** | (2006.01) |
| ***B05B 1/02*** | (2006.01) |
| ***B05B 1/04*** | (2006.01) |
| ***B05B 1/14*** | (2006.01) |

(52) U.S. Cl.

CPC ... *F25C 3/04* (2013.01); *B05B 1/02* (2013.01); *B05B 1/044* (2013.01); *B05B 1/14* (2013.01)

(58) Field of Classification Search

CPC ..... B05B 1/14; B05B 1/044; B05B 1/02; F25C 3/04

USPC ..... 239/14.1, 14.2, 419.5, 423, 424, 425.5, 239/428.5, 433, 543, 544, 548, 550

See application file for complete search history.

(56) References Cited

U.S. PATENT DOCUMENTS

| | | | |
|---|---|---|---|
| 1,844,187 | A | 2/1932 | Smith |
| 3,301,485 | A | 1/1967 | Tropeano et al. |
| 3,383,054 | A | 5/1968 | Nugarus |
| 3,716,190 | A | 2/1973 | Lindlof |
| 3,761,020 | A | 9/1973 | Tropeano et al. |
| 3,776,471 | A | 12/1973 | Meyer et al. |
| 3,908,903 | A | 9/1975 | Burns, Jr. |
| 3,969,908 | A | 7/1976 | Lawless et al. |
| 4,004,732 | A | 1/1977 | Hanson |
| 4,141,507 | A | 2/1979 | Rump |
| 4,145,000 | A | 3/1979 | Smith et al. |
| 4,343,434 | A | 8/1982 | Haruch |
| 4,349,156 | A | 9/1982 | Haruch et al. |
| 4,353,504 | A | 10/1982 | Girardin et al. |

(Continued)

FOREIGN PATENT DOCUMENTS

| | | | |
|---|---|---|---|
| CA | 2015646 | C | 7/2002 |
| DE | 2855906 | A1 | 7/1980 |

(Continued)

*Primary Examiner* — Steven J Ganey

(74) *Attorney, Agent, or Firm* — Paul C. Oestreich; Eminent IP, P.C.

(57) ABSTRACT

Various embodiments of multi-step snowmaking guns are disclosed. More particularly, embodiments of a six-step, a four-step and a single step snowmaking gun are disclosed. Embodiments of the multi-step snowmaking guns may generally characterized by having a bottom manifold connected to a main mast, which is connected to a nozzle manifold, which in turn may be connected to a multi-step fluid nozzle. Embodiments of the multi-step snowmaking guns may further be generally characterized as having a nucleator head connected to a nucleator mast which is in turn also connected to the nozzle manifold.

24 Claims, 20 Drawing Sheets

(56) References Cited

U.S. PATENT DOCUMENTS

| | | | | |
|---|---|---|---|---|
| 4,383,646 | A | 5/1983 | Smith | |
| 4,442,047 | A | 4/1984 | Johnson | |
| 4,465,230 | A | 8/1984 | Ash | |
| 4,516,722 | A | 5/1985 | Avery | |
| 4,742,959 | A | 5/1988 | Stanchak et al. | |
| 4,793,554 | A | 12/1988 | Kraus et al. | |
| 4,903,895 | A | 2/1990 | Mathewson et al. | |
| 4,915,302 | A | 4/1990 | Kraus et al. | |
| 4,993,635 | A | 2/1991 | Dupre | |
| 5,004,151 | A | 4/1991 | Dupre | |
| 5,064,118 | A | 11/1991 | Lauricella | |
| 5,090,619 | A | 2/1992 | Barthold et al. | |
| 5,135,167 | A | 8/1992 | Ringer | |
| 5,154,348 | A | 10/1992 | Ratnik et al. | |
| 5,385,218 | A * | 1/1995 | Migliori | 91/23 |
| 5,520,331 | A | 5/1996 | Wolfe | |
| 5,529,242 | A | 6/1996 | Hedin | |
| 5,593,090 | A | 1/1997 | Werner | |
| 5,692,682 | A | 12/1997 | Soule et al. | |
| 5,699,961 | A | 12/1997 | Ratnik et al. | |
| 5,810,251 | A | 9/1998 | McKinney | |
| 5,823,436 | A | 10/1998 | Waldrum | |
| 5,884,841 | A * | 3/1999 | Ratnik et al. | 239/14.2 |
| 5,909,844 | A | 6/1999 | Nilsson | |
| 5,934,556 | A | 8/1999 | Charriau et al. | |
| 6,007,676 | A | 12/1999 | Bartels et al. | |
| 6,032,872 | A | 3/2000 | Dupre | |
| 6,119,956 | A | 9/2000 | McKinney | |
| 6,129,290 | A | 10/2000 | Nikkanen | |
| 6,152,380 | A | 11/2000 | Dupre | |
| 6,161,769 | A | 12/2000 | Kircher et al. | |
| 6,182,905 | B1 | 2/2001 | Dupre | |
| 6,402,047 | B1 | 6/2002 | Thomas | |
| 6,508,412 | B1 | 1/2003 | Pergay et al. | |
| 6,547,157 | B2 | 4/2003 | Jervas | |
| 6,719,209 | B1 | 4/2004 | Pergay et al. | |
| 6,793,148 | B2 | 9/2004 | Ratnik | |
| 7,114,662 | B1 | 10/2006 | Nikkanen | |
| 7,124,964 | B2 | 10/2006 | Bui | |
| 7,290,722 | B1 * | 11/2007 | Ewald | 239/14.2 |
| 7,546,960 | B2 | 6/2009 | Stofner | |
| 7,770,816 | B2 | 8/2010 | Rieder | |
| 8,393,553 | B2 | 3/2013 | Sankrithi et al. | |
| 8,534,577 | B2 | 9/2013 | Dodson | |
| D692,528 | S | 10/2013 | Dodson | |
| D692,982 | S | 11/2013 | Dodson | |
| D693,902 | S | 11/2013 | Dodson | |
| 2004/0046041 | A1 | 3/2004 | Dupre | |
| 2004/0112976 | A1 | 6/2004 | Galvin et al. | |
| 2006/0049273 | A1 | 3/2006 | Zhang | |
| 2006/0071091 | A1 | 4/2006 | Ratnik | |
| 2006/0113400 | A1 | 6/2006 | Dodson | |
| 2011/0049258 | A1 * | 3/2011 | Lehner et al. | 239/14.2 |
| 2011/0168808 | A1 | 7/2011 | Mitch | |
| 2011/0174895 | A1 * | 7/2011 | Ratnik et al. | 239/14.2 |

FOREIGN PATENT DOCUMENTS

| | | | |
|---|---|---|---|
| DE | 29438056 | A | 3/1981 |
| DE | 19819982 | A1 | 9/1999 |
| DE | 19838785 | A1 | 3/2000 |
| DE | 10215580 | A1 | 10/2003 |
| DE | 102004053984 | B3 | 6/2006 |
| EP | 0787959 | A1 | 8/1997 |
| EP | 00824658 | B1 | 2/1998 |
| EP | 00835162 | B1 | 4/1998 |
| EP | 1283400 | A2 | 2/2003 |
| EP | 1473528 | A1 | 11/2004 |
| FR | 2594528 | A1 | 8/1987 |
| FR | 2617273 | A1 | 12/1988 |
| FR | 2877076 | A1 | 4/2006 |
| GB | 2214108 | A | 8/1989 |
| JP | 2005127577 | A | 5/2005 |
| WO | WO90/12264 | A1 | 10/1990 |
| WO | WO94/19655 | A1 | 9/1994 |
| WO | WO97/01392 | A1 | 1/1997 |
| WO | WO03/054460 | A1 | 7/2003 |
| WO | WO03/084668 | A2 | 10/2003 |
| WO | WO2004/087329 | A1 | 10/2004 |
| WO | WO2009/043092 | A1 | 4/2009 |
| WO | WO2010/036372 | A1 | 4/2010 |

* cited by examiner

SINGLE AND MULTI-STEP SNOWMAKING GUNS

CROSS-REFERENCE TO RELATED APPLICATIONS

This U.S. Nonprovisional Patent Application claims the benefit and priority of U.S. Provisional Patent Application No. 61/694,255, filed, Aug. 29, 2012, titled: SIX-STEP SNOW-MAKING GUN, Aug. 29, 2013 and U.S. Provisional Patent Application No. 61/694,250, filed, Aug. 29, 2012, titled: FOUR-STEP SNOW-MAKING GUN, Aug. 29, 2013 and U.S. Provisional Patent Application No. 61/694,256, filed, Aug. 29, 2012, titled: SINGLE-STEP SNOW-MAKING GUN, Aug. 29, 2013 and U.S. Provisional Patent Application No. 61/694,262, filed, Aug. 29, 2012, titled: MODULAR DUAL VECTOR FLUID SPRAY NOZZLES, Aug. 29, 2013. The contents of all four of the aforementioned provisional patent applications are expressly incorporated by reference, for all purposes, as if fully set forth herein.

This U.S. Nonprovisional Patent Application is related to U.S. patent application Ser. No. 14/013,582, filed contemporaneously on Aug. 29, 2013, titled: MODULAR DUAL VECTOR FLUID SPRAY NOZZLES, pending. This U.S. Nonprovisional Patent Application is further related to U.S. patent application Ser. No. 12/998,141, filed on Mar. 22, 2011, titled: FLAT JET FLUID NOZZLES WITH ADJUSTABLE DROPLET SIZE INCLUDING FIXED OR VARIABLE SPRAY ANGLE, now U.S. Pat. No. 8,534,577, issued Sep. 17, 2013, which is a National Stage of International Patent Application No. PCT/US2009/005345 filed on Sep. 25, 2009, titled: FLAT JET FLUID NOZZLES WITH ADJUSTABLE DROPLET SIZE INCLUDING FIXED OR VARIABLE SPRAY ANGLE, now expired, which in turn claims benefit and priority to Australian Provisional Patent Application No. 2008904999, filed on Sep. 25, 2008, titled "PLUMES", also expired. The contents of all of the aforementioned patent applications are expressly incorporated by reference, for all purposes, as if fully set forth herein.

Finally, this U.S. Nonprovisional Patent Application is also related to U.S. Design Patent Application No. 29/430,677, filed on Aug. 29, 2012, titled: SIX-STEP SNOW-MAKING GUN, now U.S. Design Patent No. D692,528, issued on Oct. 29, 2013, U.S. Design Patent Application No. 29/430,678, filed on Aug. 29, 2012, titled: FOUR-STEP SNOW-MAKING GUN, now U.S. Design Patent No. D693,902, issued Nov. 19, 2013, and U.S. Design Patent Application No. 29/430,679, filed on Aug. 29, 2012, titled: SINGLE-STEP SNOW-MAKING GUN, now U.S. Design Patent No. D692,982, issued Nov. 5, 2013. The contents of all of the aforementioned design patents are also expressly incorporated by reference, for all purposes, as if fully set forth herein.

BACKGROUND OF THE INVENTION

1. Field of the Invention

The present invention relates generally to snowmaking equipment. More particularly, this invention relates to single, four-step and six-step snowmaking guns particularly useful for producing snow at ski resorts and anywhere else that has sufficiently cold atmospheric conditions.

2. Description of Related Art

The production of artificial snow is well known in the art. Conventional snow guns or snow lances of various forms find application particularly in winter sports areas. According to one known method, a jet of ice nuclei, or seed crystals, is produced in a "nucleator nozzle" and is brought into contact with a jet composed of water droplets some distance above ground in the atmosphere. By means of said "germination", or "seeding", snow is produced from the cooling water droplets prior to falling on the ground.

In order to produce the ice nuclei, water is cooled and atomized, typically with the use of compressed air. An essential parameter for economical operation of nucleator nozzles of this type is the quantity of compressed air which has to be used to achieve significant and useful snow production. The quantity of compressed air generally determines the energy input and ultimately the operating costs of such snowmaking systems. A further essential operating parameter relates to the wet bulb temperature of the atmospheric surroundings. Conventional snow lances, are known to produce artificial snow up to approximate −3° C. It would be desirable to produce artificial snow at even higher temperatures with less energy input.

Convergent nucleator nozzles are known to produce ice nuclei. In a convergent nozzle, the cross-section in the nozzle fluid channel becomes continuously narrower in the direction of the exit orifice. Examples of such convergent nucleator nozzles include, e.g., FR 2 617 273, U.S. Pat. No. 4,145,000, U.S. Pat. No. 4,516,722, U.S. Pat. No. 3,908,903 or FR 2 594 528. In addition, convergent-divergent nucleator nozzles in accordance with the Laval principal are also known. Nucleator nozzles of this type are shown, e.g., in U.S. Pat. No. 4,903,895, U.S. Pat. No. 3,716,190, U.S. Pat. No. 4,793,554 and U.S. Pat. No. 4,383,646. However, these conventional nucleator nozzles generally require a relatively large energy input in order to produce the nuclei.

Snow lances in which nucleator nozzles and water nozzles are arranged adjacent to one another on a lance body such that the ice nuclei and water droplets produced are brought into contact with one another in a germination zone adjacent to the lance body are well known. Solutions of this type are shown, for example, in DE 10 2004 053 984 B3, U.S. Patent Pub. No. 2011/0049258, U.S. Pat. No. 7,114,662, U.S. Pat. No. 6,508,412, U.S. Pat. No. 6,182,905, U.S. Pat. No. 6,032,872 and U.S. Pat. No. 5,810,251. However, most conventional nucleator nozzles and snow lances can only be used at relatively low atmospheric and water source temperatures. Additionally, such conventional snow guns generally have little range of snowmaking output.

There is a need for improved snowmaking guns that produce snow at higher temperatures, using less energy and producing more snow than conventional snow guns. It would be particularly useful to have a snowmaking gun that has discrete levels or steps of snowmaking production capability to adjust production on the fly.

SUMMARY OF THE INVENTION

Single and multi-step snowmaking guns are disclosed. More particularly Embodiments of a six-step, a four-step and a single-step snowmaking guns are disclosed.

An embodiment of a multi-step snowmaking gun is disclosed. This embodiment of a multi-step snowmaking gun may include a bottom manifold having fixtures for receiving pressurized water and compressed air. This embodiment of a multi-step snowmaking gun may further include an elongated hollow main mast connected to the bottom manifold. This embodiment of a multi-step snowmaking gun may further include a nucleator head for generating atomized ice crystals from the pressurized water and the compressed air. This embodiment of a multi-step snowmaking gun may further include an elongated hollow nucleator mast connected to the nucleator head. This embodiment of a multi-step snowmaking gun may further include a multi-step fluid nozzle for generating atomized water jets from the pressurized water, the nozzle configured to be operated in discrete production levels measured in steps of atomized water droplet jet production. Finally, this embodiment of a multi-step snowmaking gun may further include a nozzle manifold having a nozzle manifold body configured to mate with the elongated main mast, the elongated nucleator mast and the multi-step fluid nozzle.

Another embodiment of a multi-step snowmaking gun is disclosed. This embodiment of a multi-step snowmaking gun may include a bottom manifold having fixtures for receiving pressurized water and compressed air. This embodiment of a multi-step snowmaking gun may further include a nozzle manifold having a nozzle manifold body configured for receiving and delivering the pressurized water and the compressed air. This embodiment of a multi-step snowmaking gun may further include an elongated hollow main mast connected between the bottom manifold and the nozzle manifold for delivering the pressurized water and the compressed air from the bottom manifold to the nozzle manifold. This embodiment of a multi-step snowmaking gun may further include a multi-step fluid nozzle connected to the nozzle manifold for receiving the pressurized water and generating and expelling atomized water jets into the atmosphere. This embodiment of a multi-step snowmaking gun may further include an elongated hollow nucleator mast connected to the nozzle manifold and configured for receiving and delivering the pressurized water and the compressed air. Finally, this embodiment of a multi-step snowmaking gun may further include a nucleator head connected to the nucleator mast configured for receiving the pressurized water and the compressed air and generating atomized ice crystals from the pressurized water and the compressed air for expelling into the atmosphere in the path of the water jets, thereby generating artificial snow under selected atmospheric conditions.

Another embodiment of a multi-step snowmaking gun is disclosed. This embodiment of a multi-step snowmaking gun may include a bottom manifold having fixtures for receiving pressurized water and compressed air, the bottom manifold further comprising a first end main mast receptacle. This embodiment of a multi-step snowmaking gun may further include a nozzle manifold having a second end main mast receptacle, a nozzle receptacle and a first end nucleator mast receptacle, the nozzle manifold further configured for receiving the pressurized water and the compressed air, delivering the pressurized water to the nozzle receptacle and to the first end nucleator mast receptacle. This embodiment of a multi-step snowmaking gun may further include an elongated hollow main mast having a main mast first end connected to the first end main mast receptacle of the bottom manifold, and having a main mast second end connected to the second end main mast receptacle of the nozzle manifold for delivering the pressurized water and the compressed air from the bottom manifold to the nozzle manifold. This embodiment of a multi-step snowmaking gun may further include a multi-step water nozzle connected to the nozzle receptacle of the nozzle manifold, the nozzle configured for receiving the pressurized water and generating and expelling atomized water jets into the atmosphere as composite dual vector water jets, the composite dual vector water jets having distinctive horizontal and vertical components in a resulting spray pattern. This embodiment of a multi-step snowmaking gun may further include an elongated hollow nucleator mast having a nucleator mast first end and a nucleator mast second end, wherein the nucleator mast first end is connected to the first end nucleator mast receptacle of the nozzle manifold and configured for receiving and delivering the pressurized water and the compressed air to the nucleator mast second end. Finally, this embodiment of a multi-step snowmaking gun may further include a nucleator head connected to the nucleator mast second end of the nucleator mast, the nucleator head configured for receiving the pressurized water and the compressed air and generating atomized ice crystals from the pressurized water in combination with the compressed air for expelling the atomized ice crystals into the atmosphere in the path of the water jets, thereby seeding snowflakes and generating artificial snow under selected atmospheric conditions.

BRIEF DESCRIPTION OF THE DRAWINGS

The following drawings illustrate exemplary embodiments for practicing the invention. Like reference numerals refer to like parts in different views or embodiments of the present invention in the drawings.

DETAILED DESCRIPTION

Figure 1:
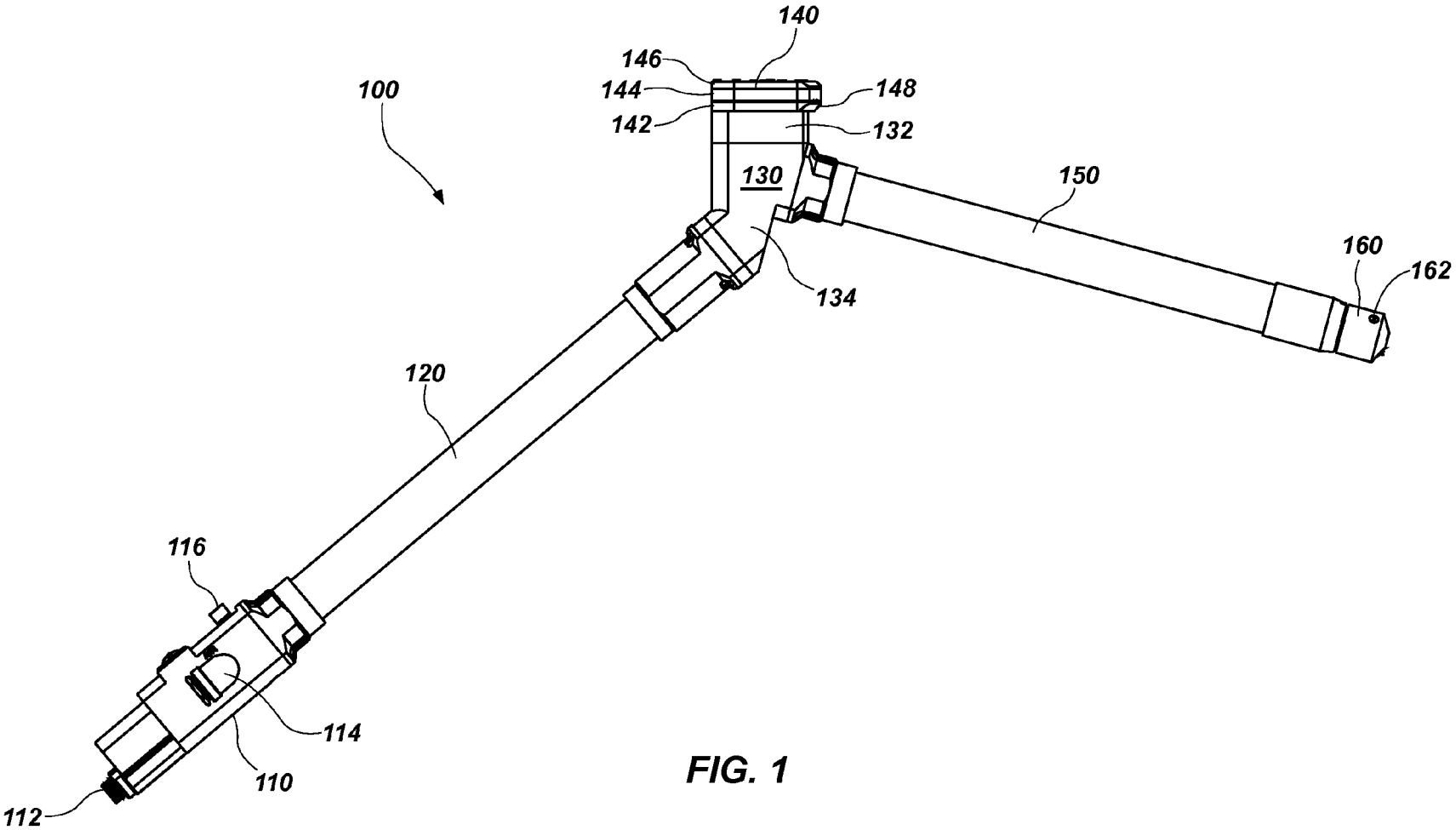
FIG. 1 is a left-side view of an embodiment of a six-step snowmaking gun, according to the present invention.

Various embodiments of a multi-step snowmaking gun are disclosed herein. Though the particular application disclosed for the gun described herein is snowmaking, it will be understood that such guns are useful in any application where the conversion of a bulk fluid is desired to be atomized and sprayed. A non-exhaustive list of such applications may include: (1) the conversion of bulk water into fine atomized water particles for projection into a cold atmosphere with or without nucleation particles for the formation of artificial snow, (2) the conversion of bulk water into fine atomized water particles for projection onto burning objects for fire-fighting, fire control and fire suppression, (3) the conversion of bulk water into fine atomized water particles for projection into the atmosphere on restaurant patios for evaporative cooling, (4) the conversion of bulk oil into fine atomized oil mists for spraying onto mechanical parts for lubrication and corrosion control, and (5) the conversion of bulk solvent into fine atomized solvent particle spray mists for use in cleaning objects of any sort, (6) the conversion of bulk paint into fine atomized paint sprays for coating objects of any sort. One of ordinary skill in the art and given this disclosure will readily comprehend the vast number of possible applications for the snowmaking gun technology disclosed herein. The application of this snowmaking gun technology to such other possible, but not expressly disclosed, applications falls within the scope and spirit of this invention and its claims.

The exemplary embodiments of a multi-step snowmaking gun disclosed herein may be formed of any suitable material, e.g., and not by way of limitation, aluminum, stainless steel, titanium, brass or any other hard material that can be shaped as disclosed herein and withstand high pressure fluids and compressed air passing through their component parts without, breaking, bending or flexing. The component parts may be manufactured using any know manufacturing process, including, but limited to, investment casting, extruding, machining and hand-forming. The exemplary embodiments of the six-step snowmaking gun shown in the drawings will be described first, followed by more general embodiments and variations described subsequently.

The snowmaking guns disclosed herein are capable of operating under a wide range flow rates, 10-85 gallons per minute (gpm) depending on nozzle characteristics, number of steps of production and water pressure (e.g., 200-600 psi). The nucleators disclosed herein require as little as 5 cubic feet per minute (cfm) of compressed air and up to about 8 cfm depending on the nucleator nozzle characteristics. That translates roughly to an operating power range of 1-1.5 kW.

Figure 2:
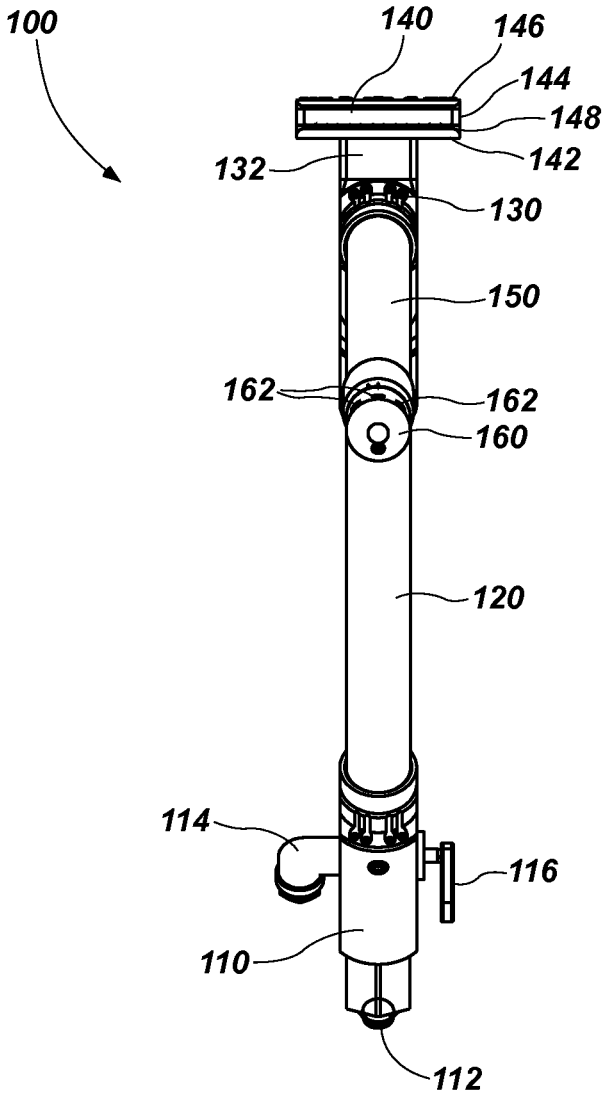
FIG. 2 is a front view of the embodiment of the six-step snowmaking gun, shown in FIG. 1.
Figure 3:
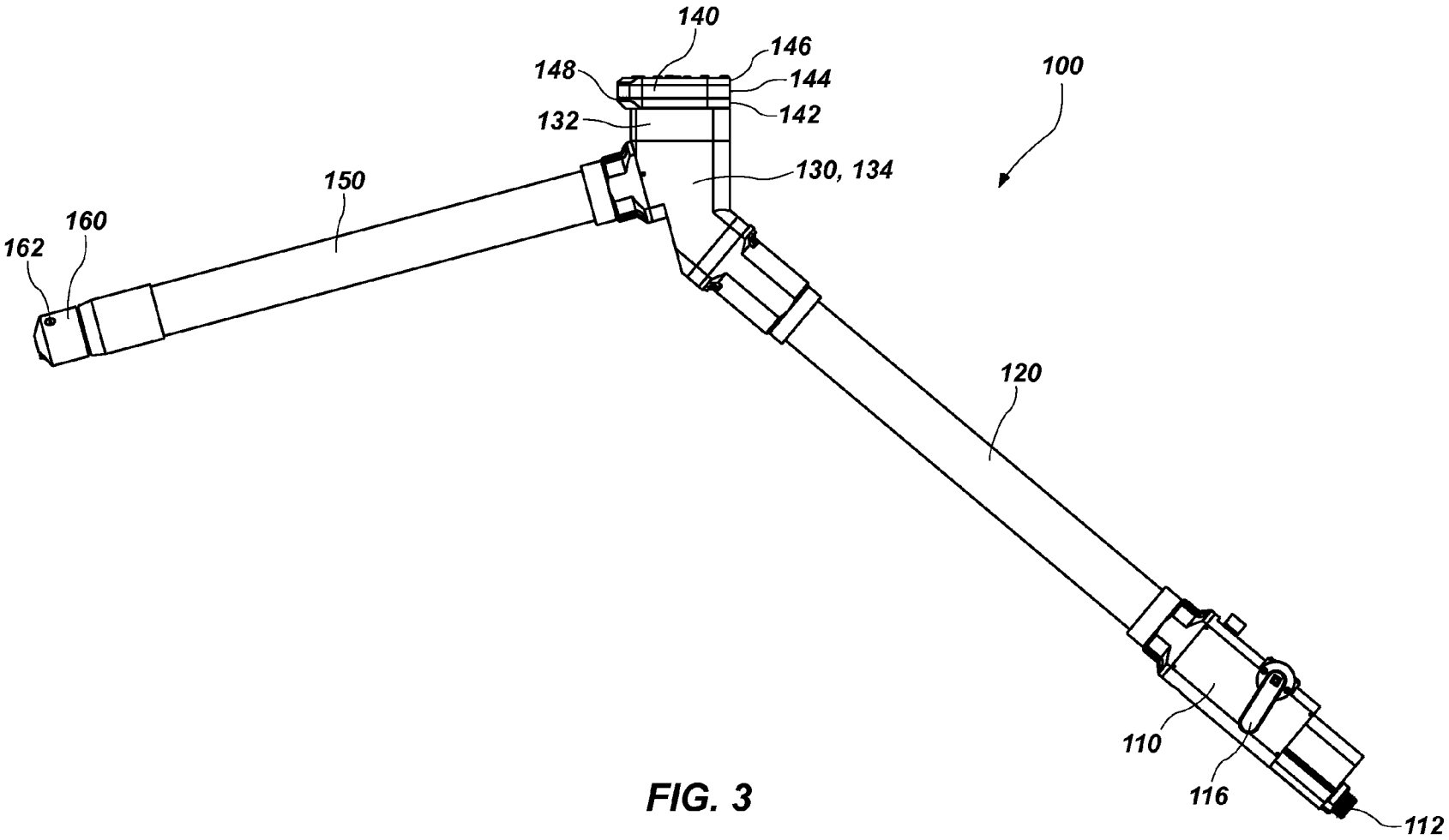
FIG. 3 is a right-side view of the embodiment of the six-step snowmaking gun, shown in FIGS. 1-2.
Figure 4:
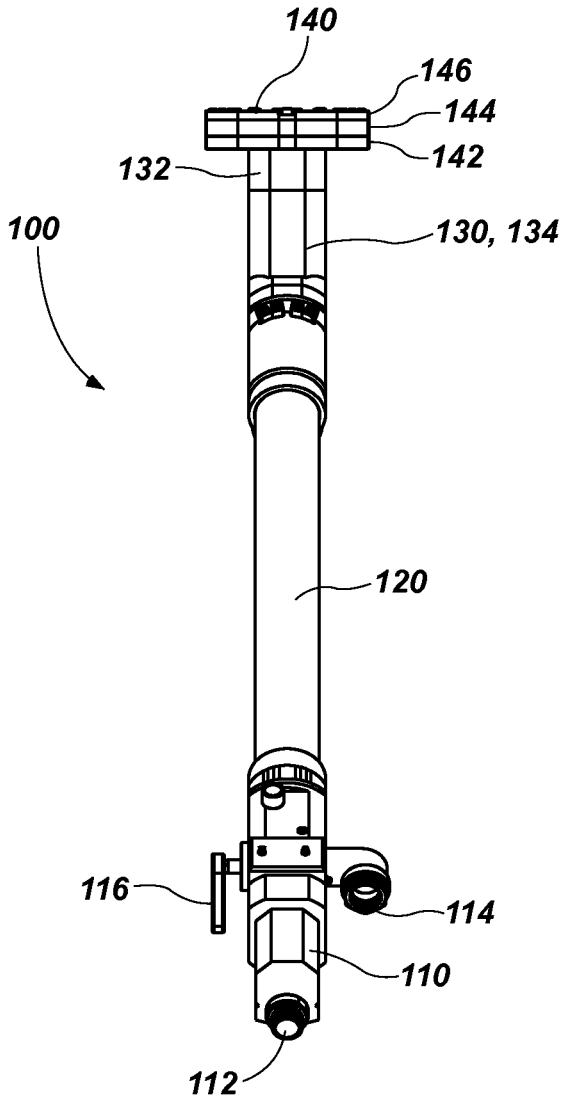
FIG. 4 is a rear view of the embodiment of the six-step snowmaking gun, shown in FIGS. 1-3.
Figure 5:
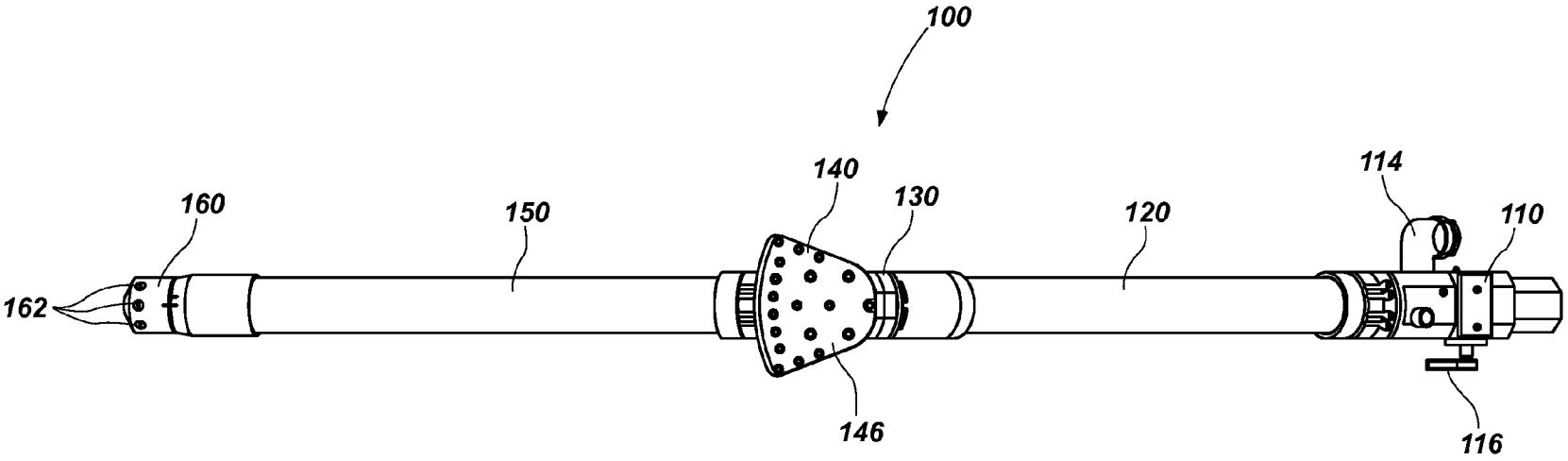
FIG. 5 is a top view of the embodiment of the six-step snowmaking gun, shown in FIGS. 1-4.
Figure 6:
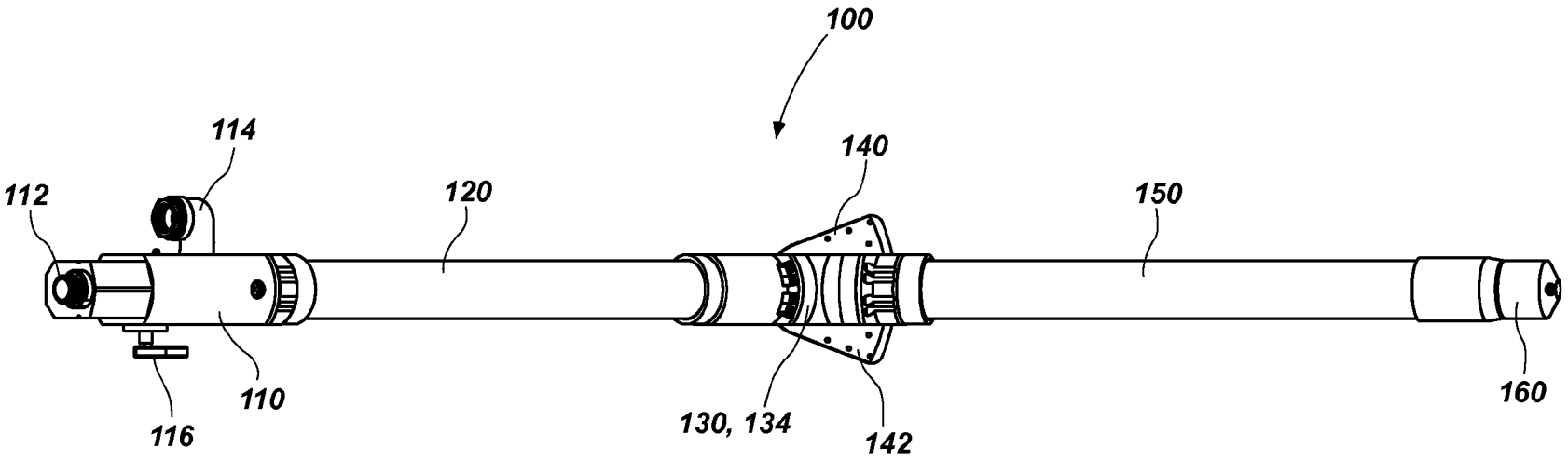
FIG. 6 is a bottom view of the embodiment of the six-step snowmaking gun, shown in FIGS. 1-5.
Figure 7:
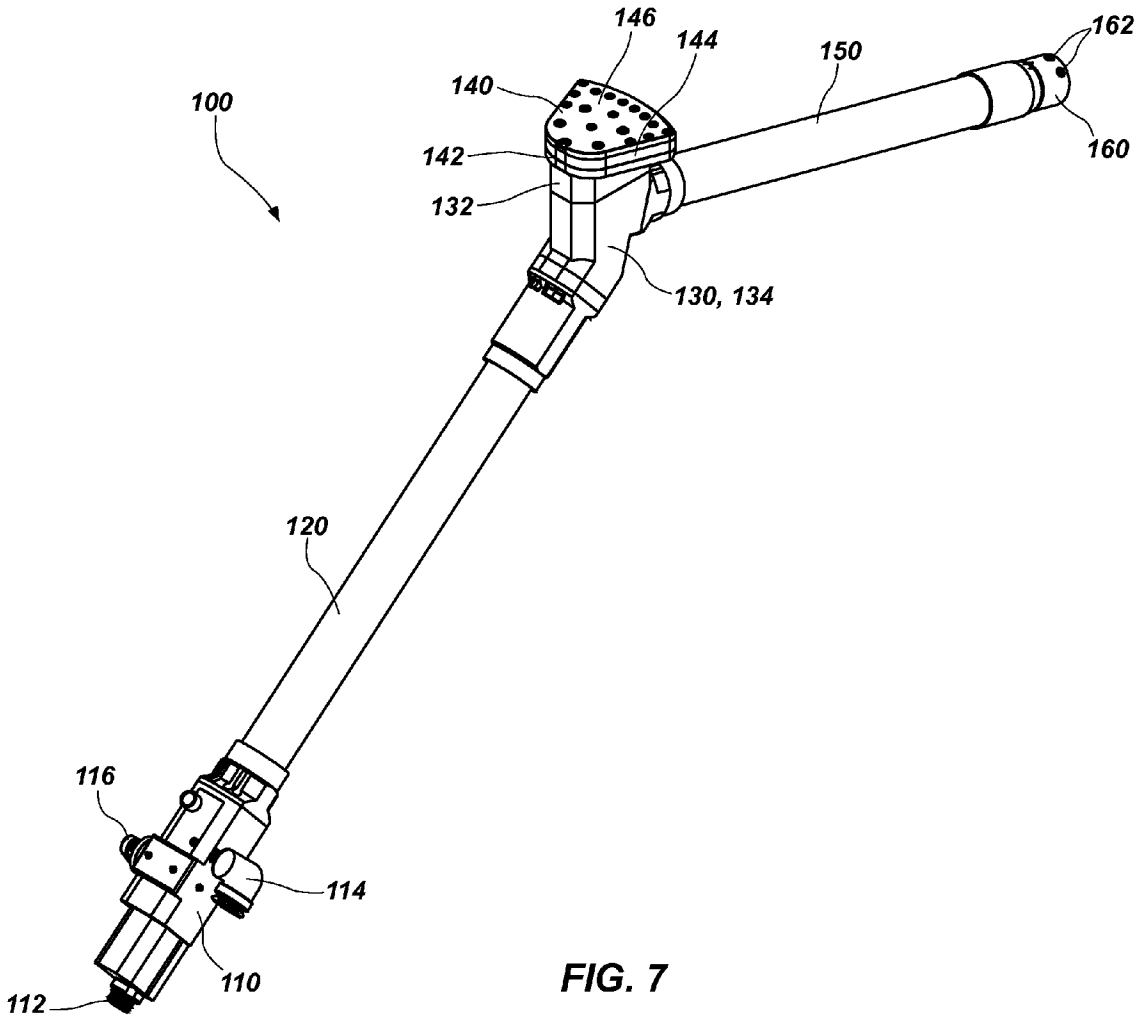
FIG. 7 is a rear perspective view of the embodiment of the six-step snowmaking gun, shown in FIGS. 1-6.
Figure 8:
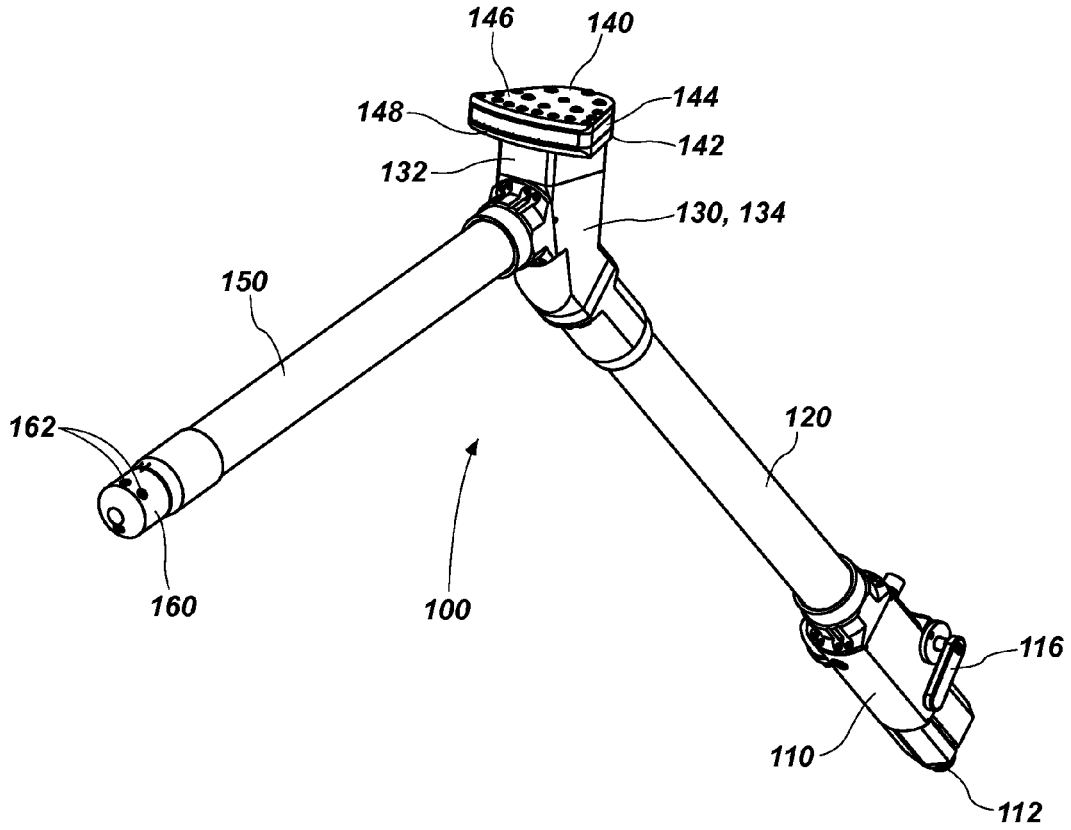
FIG. 8 is a front perspective view of the embodiment of the six-step snowmaking gun, shown in FIGS. 1-7.

Reference will now be made to FIGS. 1-8 of the drawings, which illustrate various views of an embodiment of an assembled six-step snowmaking gun 100. More particularly, FIG. 1 is a left-side view of an embodiment of the six-step snowmaking gun 100, according to the present invention. FIG. 2 is a front view of the embodiment of the six-step snowmaking gun 100, shown in FIG. 1. FIG. 3 is a right-side view of the embodiment of the six-step snowmaking gun 100, shown in FIGS. 1-2. FIG. 4 is a rear view of the embodiment of the six-step snowmaking gun 100, shown in FIGS. 1-3. FIG. 5 is a top view of the embodiment of the six-step snowmaking gun 100, shown in FIGS. 1-4. FIG. 6 is a bottom view of the embodiment of the six-step snowmaking gun 100, shown in FIGS. 1-5. FIG. 7 is a rear perspective view of the embodiment of the six-step snowmaking gun 100, shown in FIGS. 1-6. FIG. 8 is a front perspective view of the embodiment of the six-step snowmaking gun 100, shown in FIGS. 1-7.

From FIGS. 1-8, it can be seen that more substantial features of gun 100 may include a bottom manifold 110, connected to an elongated hollow main mast 120, which in turn is connected to a nozzle manifold 130. A six-step fluid nozzle 140 is connected to the nozzle manifold 130. Also connected to the nozzle manifold 130, are a nucleator mast 150 and nucleator nozzle head 160.

FIGS. 1-8 also illustrate additional features of the bottom manifold 110, including a high pressure water intake 112, a high pressure air intake 114 and pinion handle 116. The bottom manifold 110 may be configured to receive high pressure water through water intake 112. The source of pressurized water (not shown in the drawings) for use with gun 100 may be provided at various locations on ski slopes at winter recreation areas and is typically delivered through a hose (not shown) with appropriate fixtures (not shown) for mating to water intake 112. The bottom manifold 110 may also be configured to receive high pressure compressed air through air intake 114. The source of compressed air for use with gun 100 may be a compressor (not shown) or other compressed air source, again provided at various locations on ski slopes at winter recreation areas and is typically delivered through a hose (not shown) with appropriate fixtures (not shown) for mating to air intake 114.

FIGS. 1-8, further illustrate additional features of the six-step fluid nozzle 140. For example, six-step fluid nozzle 140 may include a bottom plate 142, a top plate 144, between which is formed the exit orifices 148. Six-step fluid nozzle 140 may further include a top plate 144. One particularly novel feature of the six-step fluid nozzle 140 is that it is configured with six independent intake ports, each intake port leading to one or more independent fluid channels, each fluid channel forming opposed impingement surfaces eventually forcing high pressure water to impinge at independent exit orifices. The particular aspects, structural features and workings of the six-step and other similar fluid nozzles are disclosed in U.S. patent application Ser. No. 12/998,141, filed on Mar. 22, 2011, titled: FLAT JET FLUID NOZZLES WITH ADJUSTABLE DROPLET SIZE INCLUDING FIXED OR VARIABLE SPRAY ANGLE, pending, attributed to Mitchell Joe Dodson, the inventor of the present application. Accordingly, since the contents of that patent application and U.S. Provisional Patent Application No. 61/694,255, filed, Aug. 29, 2012, titled: SIX-STEP NOW-MAKING GUN, Aug. 29, 2013 have been incorporated by reference for all purposes, including for enablement and written description, the six-step fluid nozzle 140 is further elaborated with respect to FIGS. 10A and 10B as described herein.

FIGS. 1-8 also illustrates an additional feature of the nozzle manifold 130, particularly an optional extension block 132 which may be employed to space the six-step fluid nozzle 140 a predetermined distance away from the nozzle manifold body 134. The particular thickness of the extension block 132 is substantially that predetermined distance.

FIGS. 1-8 also illustrates an additional feature of the nucleator nozzle head 160, namely nucleator nozzles 162 (up to three shown, see, e.g., FIGS. 2 and 5). The nucleator nozzles 162 are used to combine pressurized water and compressed air to generate miniature ice nuclei for seeding the water jet spray from nozzle 140. According to one embodiment, nucleator nozzles 162 may be of the convergent-divergent variety, i.e., the fluid chamber initially narrows toward the exit orifice, but then widens before the water and air mixture exits the orifice toward the ice nuclei.

Figure 9:
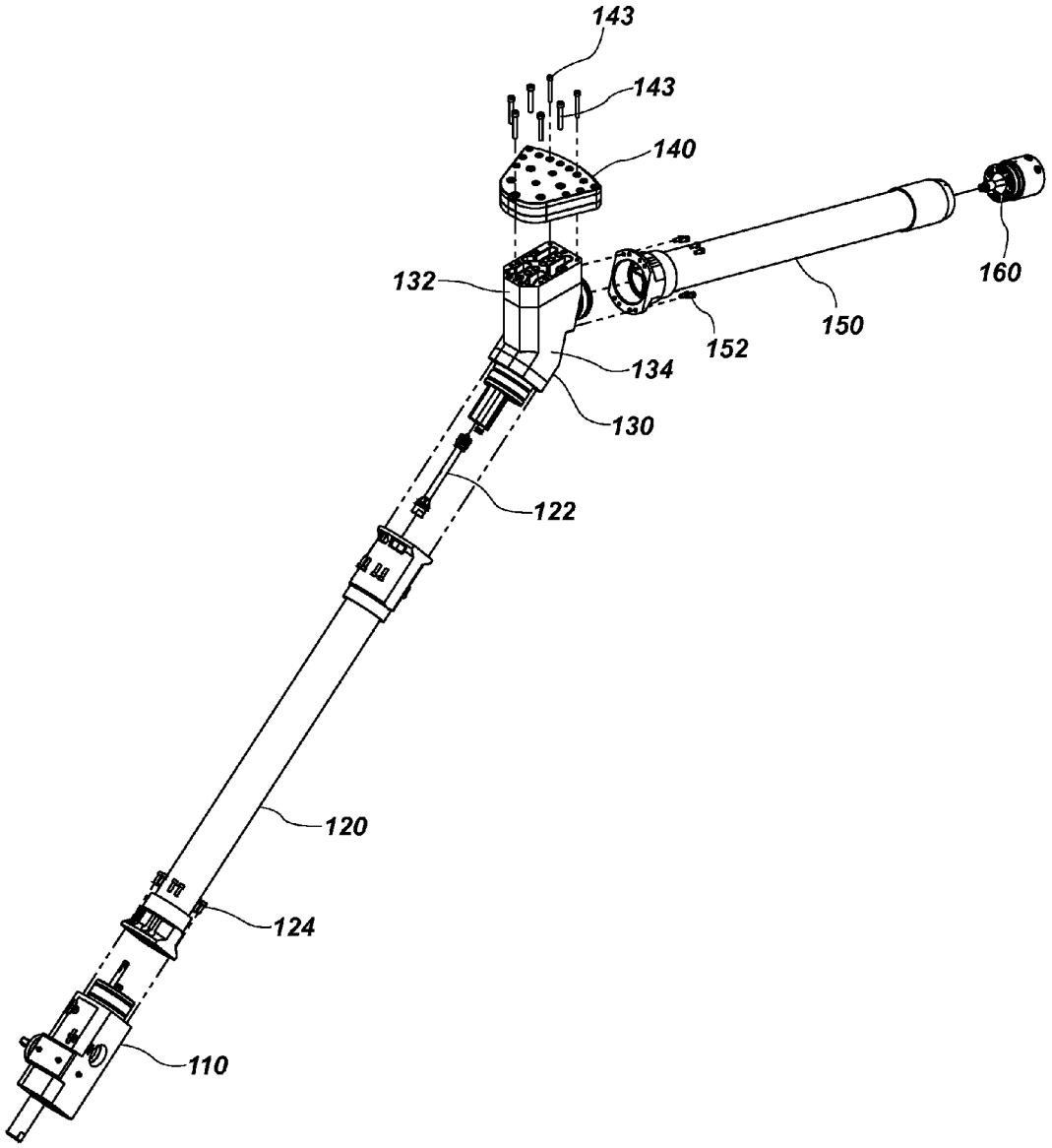
FIG. 9 is an exploded view of the six-step snowmaking gun, shown in FIGS. 1-8, according to the present invention.

FIG. 9 is an exploded view of the six-step snowmaking gun 100, shown in FIGS. 1-8, according to the present invention. From the bottom left of FIG. 9 the bottom manifold 110 is shown detached from elongated hollow main mast 120. Mast bolts 124 may be used to secure the main mast to the bottom manifold 110. A linkage (not shown in FIG. 9) is connected between the rack and pinion mechanism (not shown in FIG. 9) in the bottom manifold 110 and the plunger 122 which is inserted into the nozzle manifold 130. The nozzle manifold 130 may include an optional extension block 132 to which the six-step fluid nozzle 140 is secured using nozzle bolts 143. The elongated nucleator mast 150 may be secured to the nozzle manifold 130 using nucleator bolts 152. The nucleator head 160 is secured to the distal end 154 of the nucleator mast 150, as shown in FIG. 9.

Figure 10B:
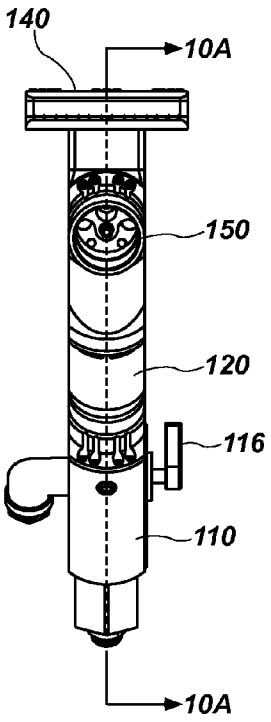
FIGS. 10A and 10B are cross-section and front views, respectively, of an assembled six-step snowmaking gun embodiment without the nucleator mast and nucleator head to illustrate operation of an embodiment of the piston for a six-step gun in production step 1, according to the present invention.
Figure 10A:
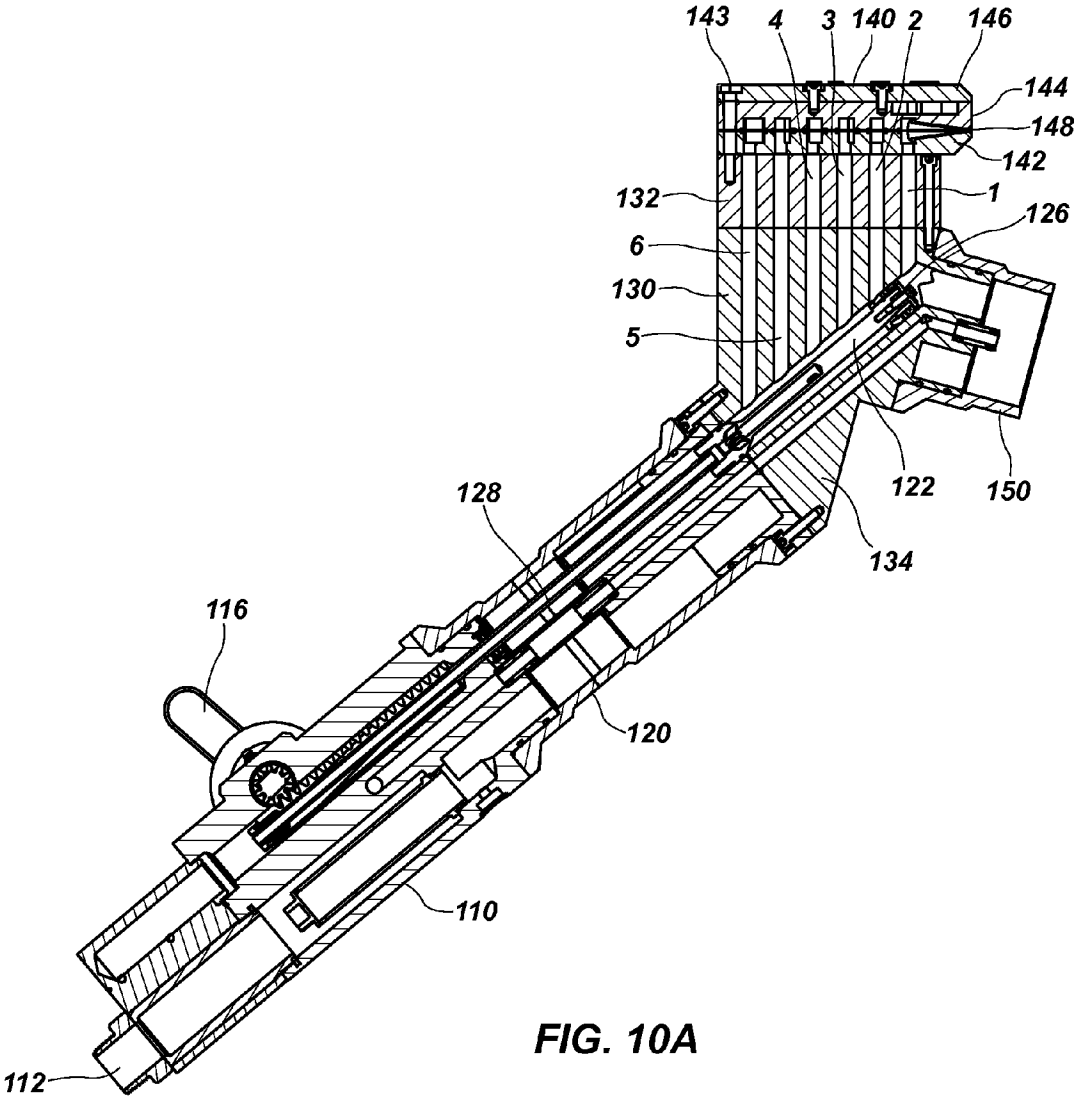
Figure 11B:
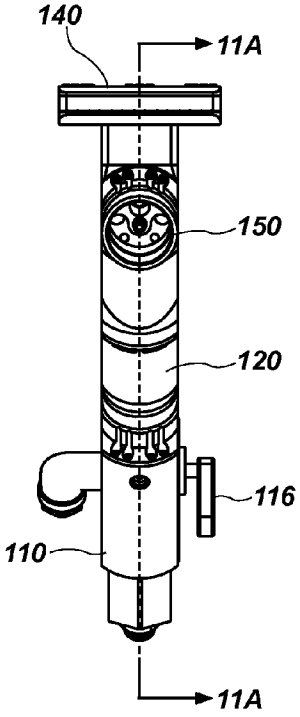
FIGS. 11A and 11B are cross-section and front views, respectively, of an embodiment of a nozzle manifold with a six-step fluid nozzle mounted thereto to illustrate operation of an embodiment of the piston for a six-step gun in production step 6, according to the present invention.
Figure 11A:
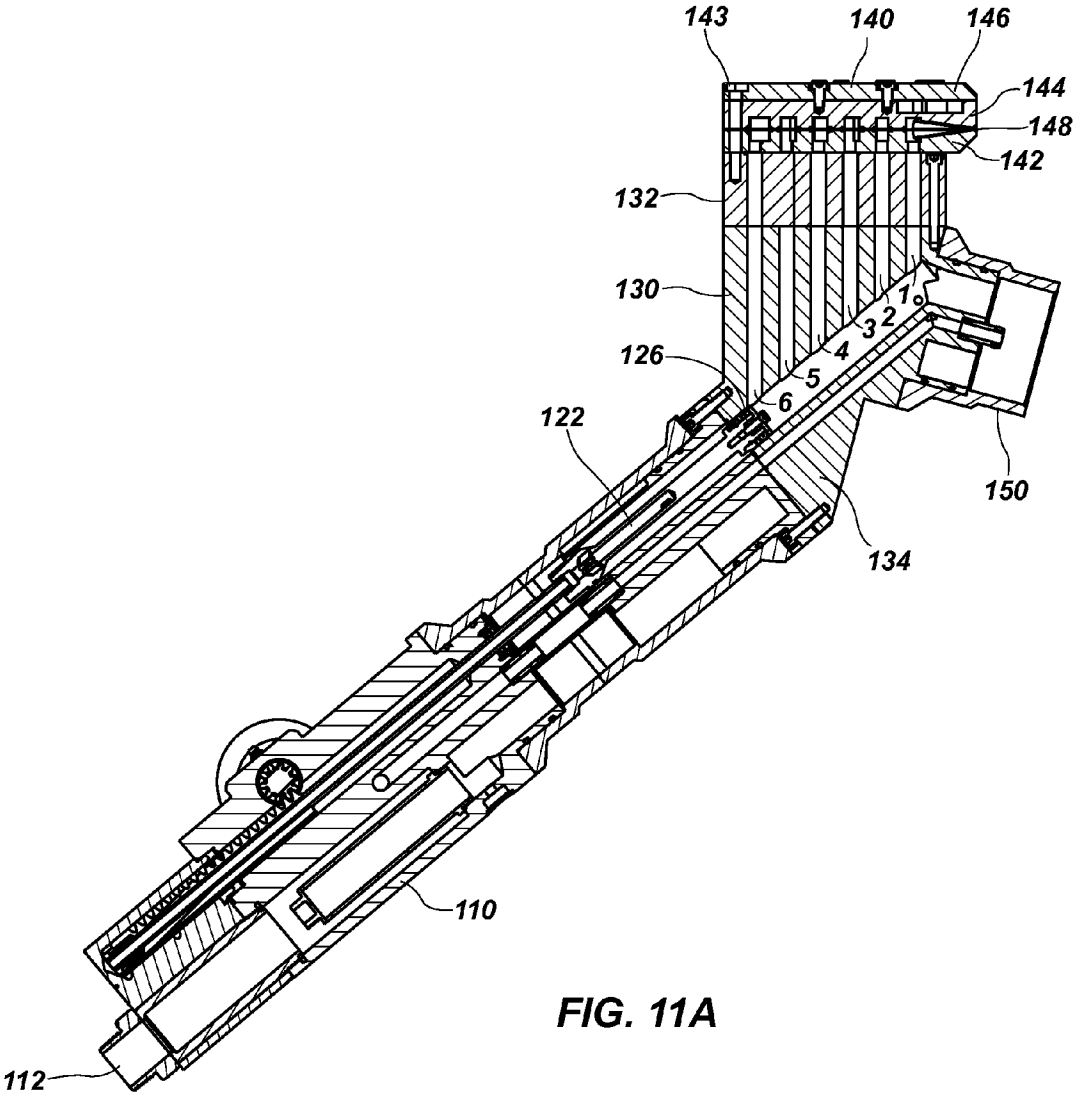

FIGS. 10A and 10B are cross-section and front views, respectively, of an assembled six-step snowmaking gun embodiment without the nucleator mast and nucleator head to illustrate operation of an embodiment of the piston for a six-step gun in production step 1, according to the present invention. Similarly, FIGS. 11A and 11B are cross-section and front views, respectively, of an assembled six-step snowmaking gun embodiment without the nucleator mast and head to illustrate operation of an embodiment of the piston for a six-step gun in production step 6, according to the present invention. As can be seen in FIGS. 10A and 11A there are six fluid source channels numbered 1-6 that feed the six independent fluid chambers within the six-step fluid nozzle 140.

FIGS. 10A and 11A both show cross-section views of an embodiment of a nozzle manifold 130 with a six-step fluid nozzle 140 mounted thereto with optional extension block 132, as well as a shortened main mast 120 and bottom manifold 110, according to the present invention. Note that the main mast 120 has been shortened in FIGS. 10A and 11A for illustration purposes. In particular, FIG. 10A illustrates operation of an embodiment of the piston 122 connected by linkage 128 to rack 111 operated on by pinion 115 to engage a six-step gun 100 (partially shown in FIGS. 10A and 10B) in production step 1. Recall that production step 1 only charges fluid source channel 1.

Whereas FIG. 11A illustrates operation of the same embodiment of the piston 122 connected by linkage 128 to rack 111 operated on by pinion 115 to engage a six-step gun 100 (partially shown in FIGS. 11A and 11B) in production step 6. In FIG. 10A, the head of plunger 122 is shown blocking fluid source channels 2-6, thereby allowing water to charge the six-step fluid nozzle in production step 1, only. Whereas in FIG. 11A, fluid source channels 1-6 are all open and operational for full water jet production. Note also that water that may have been in the channels and ports not under production (e.g., channels 2-6 in FIG. 10) is allowed to drain back through the piston 122 behind the piston head 126 and back down through the linkage 128.

Figure 12:
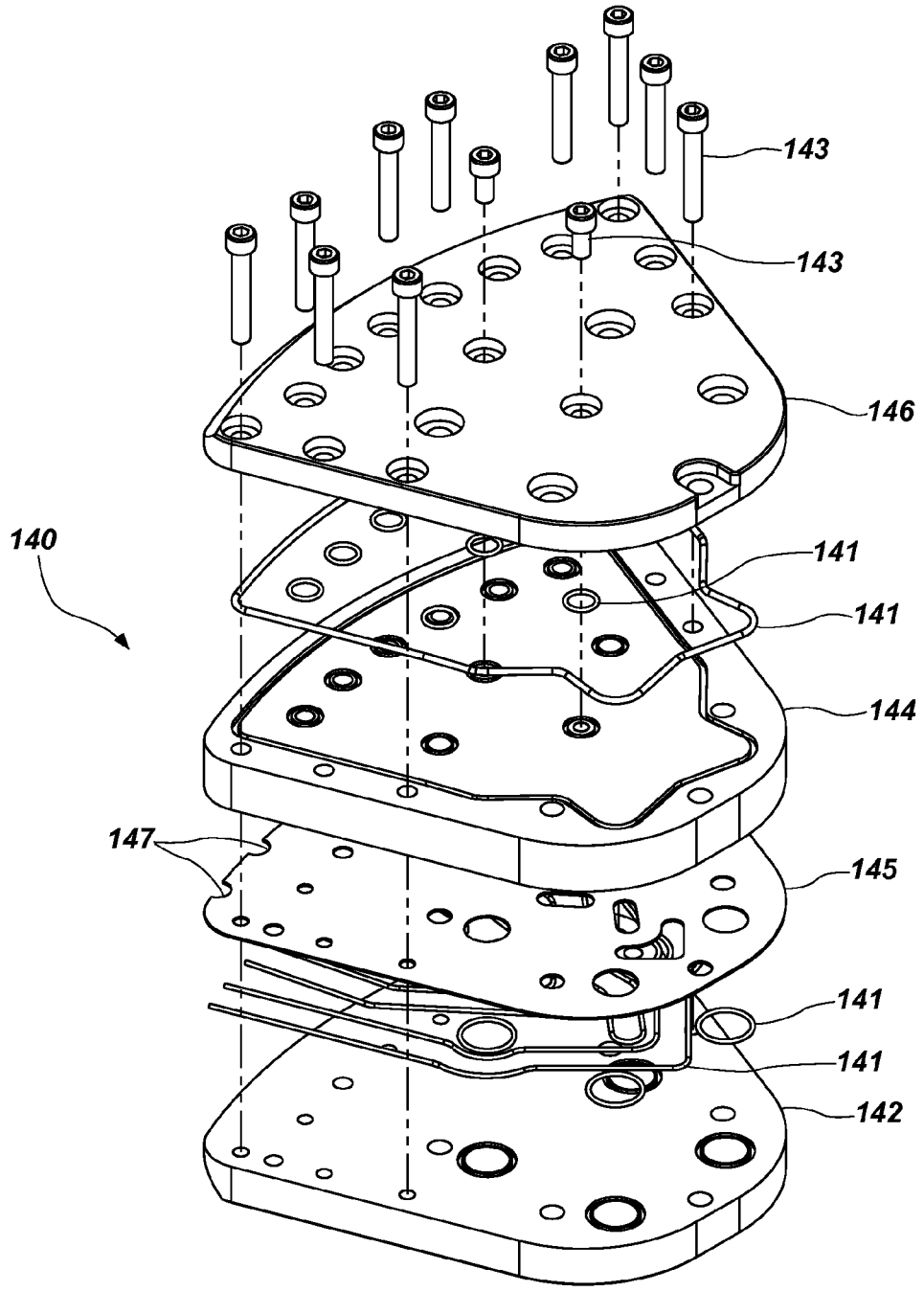
FIG. 12 is an exploded view of an exemplary six-step fluid nozzle for use with the six-step snowmaking gun, shown in FIGS. 1-9, according to the present invention.

FIG. 12 is an exploded view of an exemplary six-step fluid nozzle 140 for use with a six-step snowmaking gun 100, shown in FIGS. 1-9, according to the present invention. The basic theory of operation, component characteristics and parameters for various flat jet fluid nozzles is disclosed in the co-pending U.S. patent application Ser. No. 12/998,141, filed on Mar. 22, 2011, now U.S. Pat. No. 8,534,577, issued Sep. 17, 2013, titled: FLAT JET FLUID NOZZLES WITH ADJUSTABLE DROPLET SIZE INCLUDING FIXED OR VARIABLE SPRAY ANGLE, which has been incorporated by reference for all purposes, including enablement and written description of flat jet fluid nozzles, generally. However, there are unique component features of the exemplary six-step fluid nozzle 140 shown in FIG. 12, as further elaborated herein. More particularly, FIG. 12 illustrates a bottom plate 142, various sizes and shapes of O-rings 141, nozzle bolts 143, a top plate 144 and cover plate 146. The six independent fluid chambers are not shown in FIG. 12, but are formed between the underside of top plate 144 and the top side of gasket 145. The exit orifices (not shown) are facilitated by the notches 147 in the gasket 145. It will be understood that other fluid nozzle heads may be configured for use with the structure of nozzle manifold 130 of gun 100. Accordingly, nozzle 140 is merely exemplary.

Figure 13:
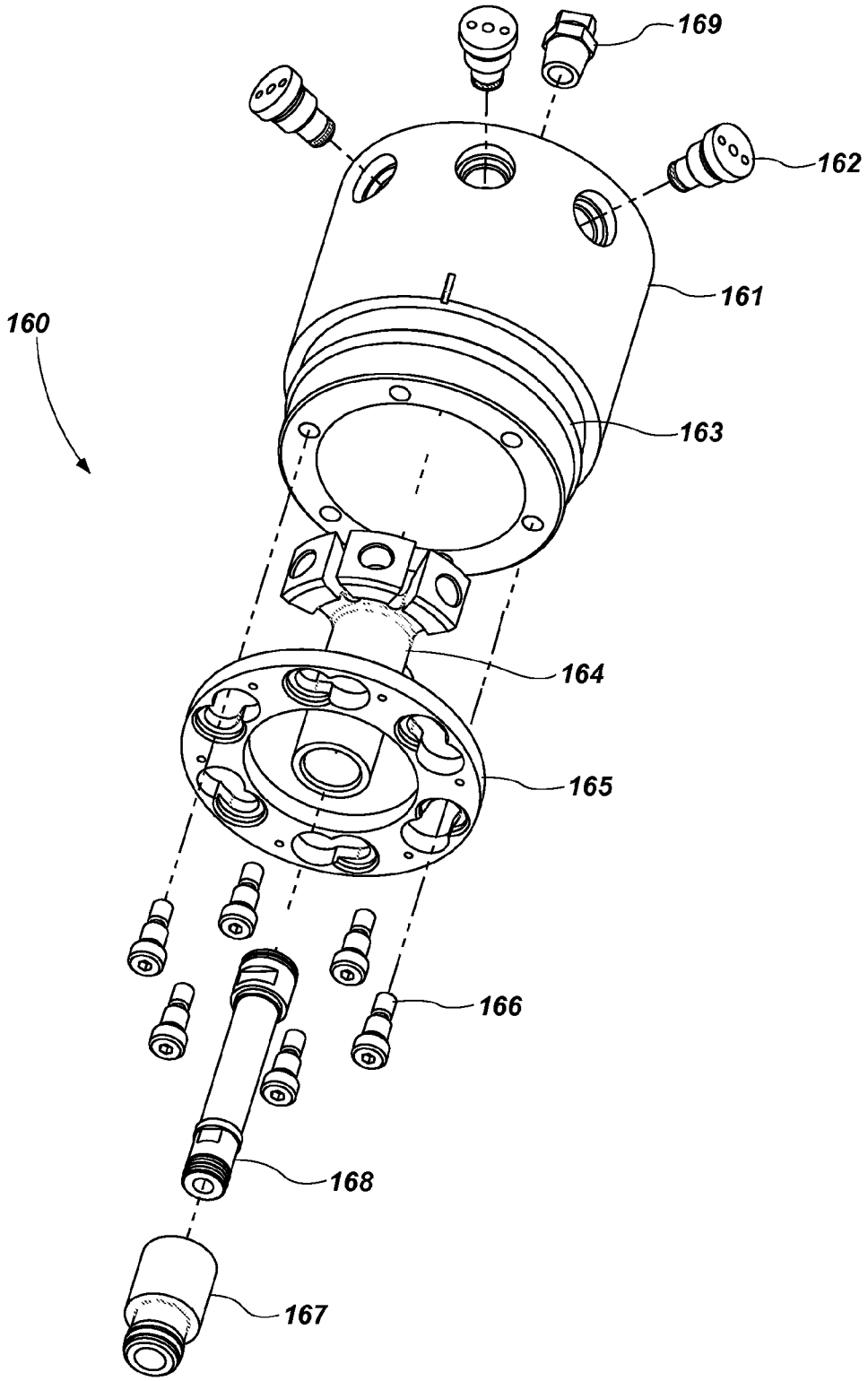
FIG. 13 is an exploded view of an exemplary nucleator head for use with the six-step snowmaking gun, shown in FIGS. 1-9, according to the present invention.

FIG. 13 is an exploded view of an exemplary nucleator head, shown generally at arrow 160 for use with the six-step snowmaking gun, shown in FIGS. 1-9, according to the present invention. As shown in FIG. 13, the exemplary nucleator head 160 may include a six-step nose cone 161 configured for receiving nucleator nozzles 162 (three shown) and an optional flat jet nozzle 169 used as a drain for the nucleator head 160. Nose cone 161 may include an O-ring 163 to seal the nucleator head 160 to the nucleator mast (not shown). Nucleator head 160 may further include a nucleator nozzle block 164 that feeds the nucleator nozzles 162, and a pressure ring 165 secured by screws 166. Nucleator head 160 may further include an airline filter splice 167 for attachment to water and air filter 168.

In operation, compressed air and pressurized water are filtered in the water and air filter 168 before mixing in the nucleator nozzle block 164 and then fed into nucleator nozzles 162 (three shown) before exiting the nozzles 162 as ice nuclei jets that mix with water jets from the nozzle 140 to produce snow. It will be understood that the trajectories of the water jets and the ice nuclei jets intersect in a germination region that forms the snowflakes that fall through cold atmosphere to the ground frozen as snow.

The nucleator head 160 is the only portion of the gun 100 that generally requires energy to operate (e.g., electricity or fuel for an air compressor). The fluid nozzle 140 runs on the water pressure alone. The nucleators disclosed here require as little as 5 cfm of compressed air and up to about 8 cfm depending on the nucleator nozzle 162 characteristics. That translates roughly to an operating power range of 1-1.5 kW of power. As a general rule, the length of the nucleator mast 150 is determined by water supply temperature, i.e., the warmer the water, the longer the mast. Finally, the angle of the nucleators 162 is determined by the minimum and maximum width of the water jet plume emanating from the nozzle 140. Thus, the angle of the nucleators is selected to maximize the germination zone for all production steps of operation.

Figure 14:
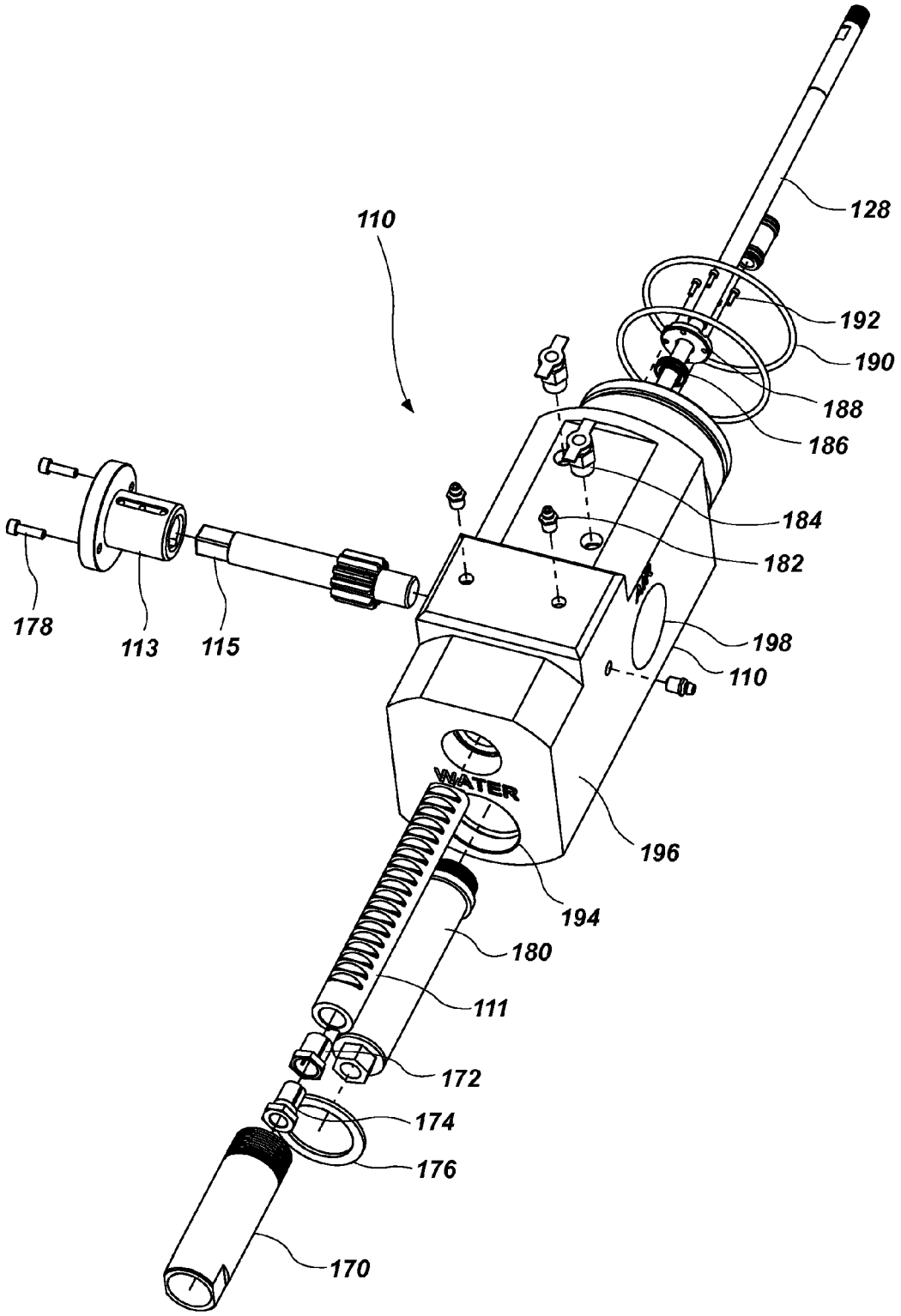
FIG. 14 is an exploded view of an exemplary bottom manifold for use with the six-step snowmaking gun, shown in FIGS. 1-9, according to the present invention.

FIG. 14 is an exploded view of an exemplary bottom manifold, shown general at arrow 110, for use with the six-step snowmaking gun 100, shown in FIGS. 1-9, according to the present invention. As shown in FIG. 14, bottom manifold body 196 houses the rack 111 and pinion 115. The pinion 115 is supported by a pinion bushing 113 mounted with pinion bushing mounting bolts 178. The rack 111 is supported by a shaft protector 170 and secured with female 172 and male 174 shaft locks. The water fixture 194 receives a mesh filter 180 with ring gasket 176. Bottom manifold body 196 also has openings for grease fittings 182 and air drain valves 184. The linkage 128 also acts as a hollow drain pipe and is supported by a rod seal 186 and capture washer seal 188 held in place by seal mounting bolts 192. One or more O-rings 190 are used to seal the bottom manifold 110. The air fixture 198 is shown on the side of bottom manifold body 196. In summary, the purpose of the bottom manifold 110 is to receive external pressurized water and air, deliver same to the main mast 120 (not shown) and control the plunger 122 (not shown) via the linkage 128 using the rack 111 and pinion 115 system.

Figure 15:
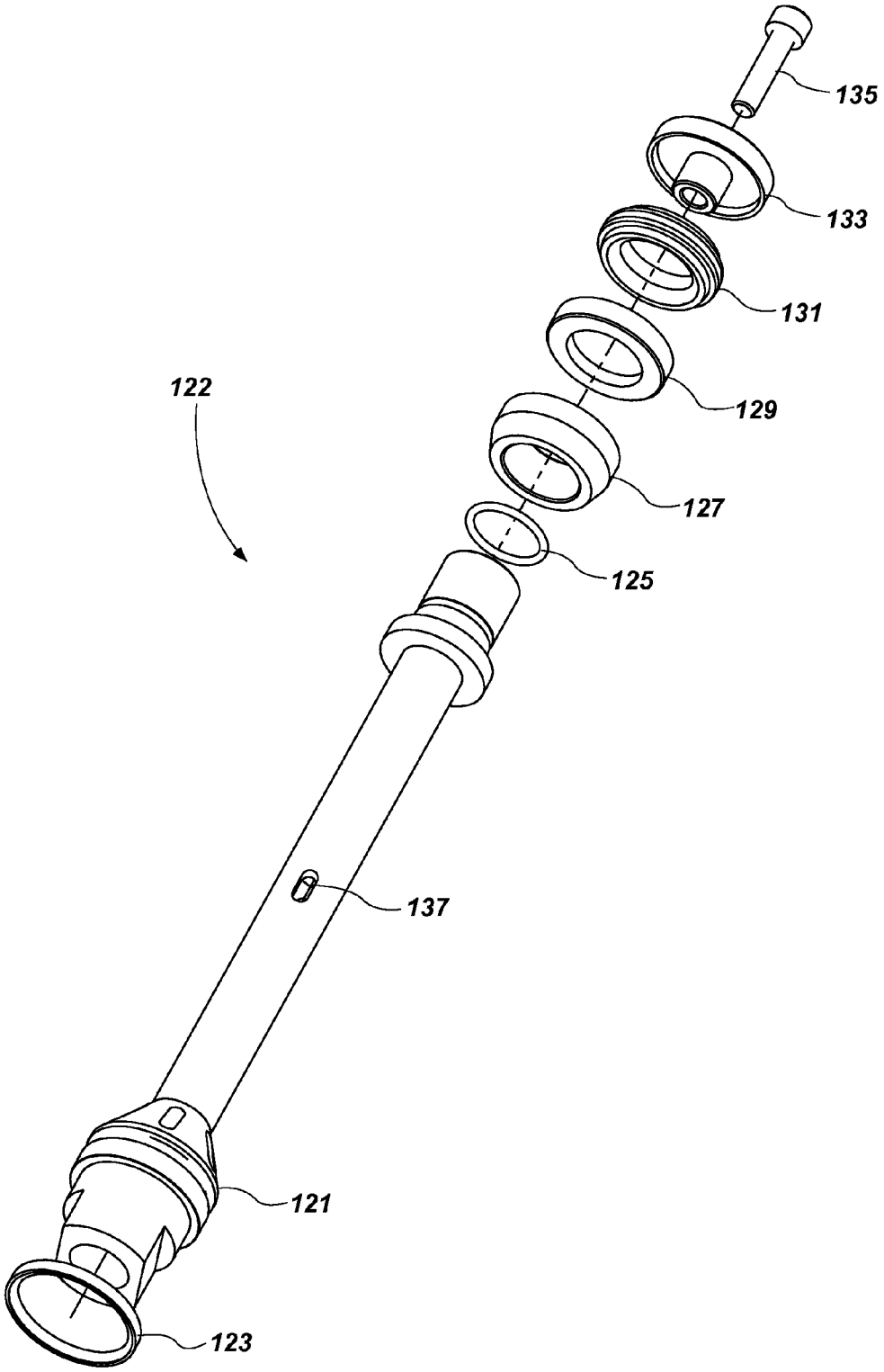
FIG. 15 is an exploded view of an exemplary plunger for use with the six-step snowmaking gun, shown in FIGS. 1-9, according to the present invention.

FIG. 15 is an exploded view of an exemplary plunger, shown generally at arrow 122, for use with the six-step snowmaking gun 100, shown in FIGS. 1-9, according to the present invention. The plunger 122 may include a two bore plunger 121 with a piston seal 123 at a proximate end. On the distal end of the embodiment of a plunger 122, there may be an O-ring 125, a seal 127, a bottom cap seal 129, a front piston seal 131, a top cap seal 133 and piston head bolt 135. The two bore plunger 121 may include a drain hole 137.

Figure 16:
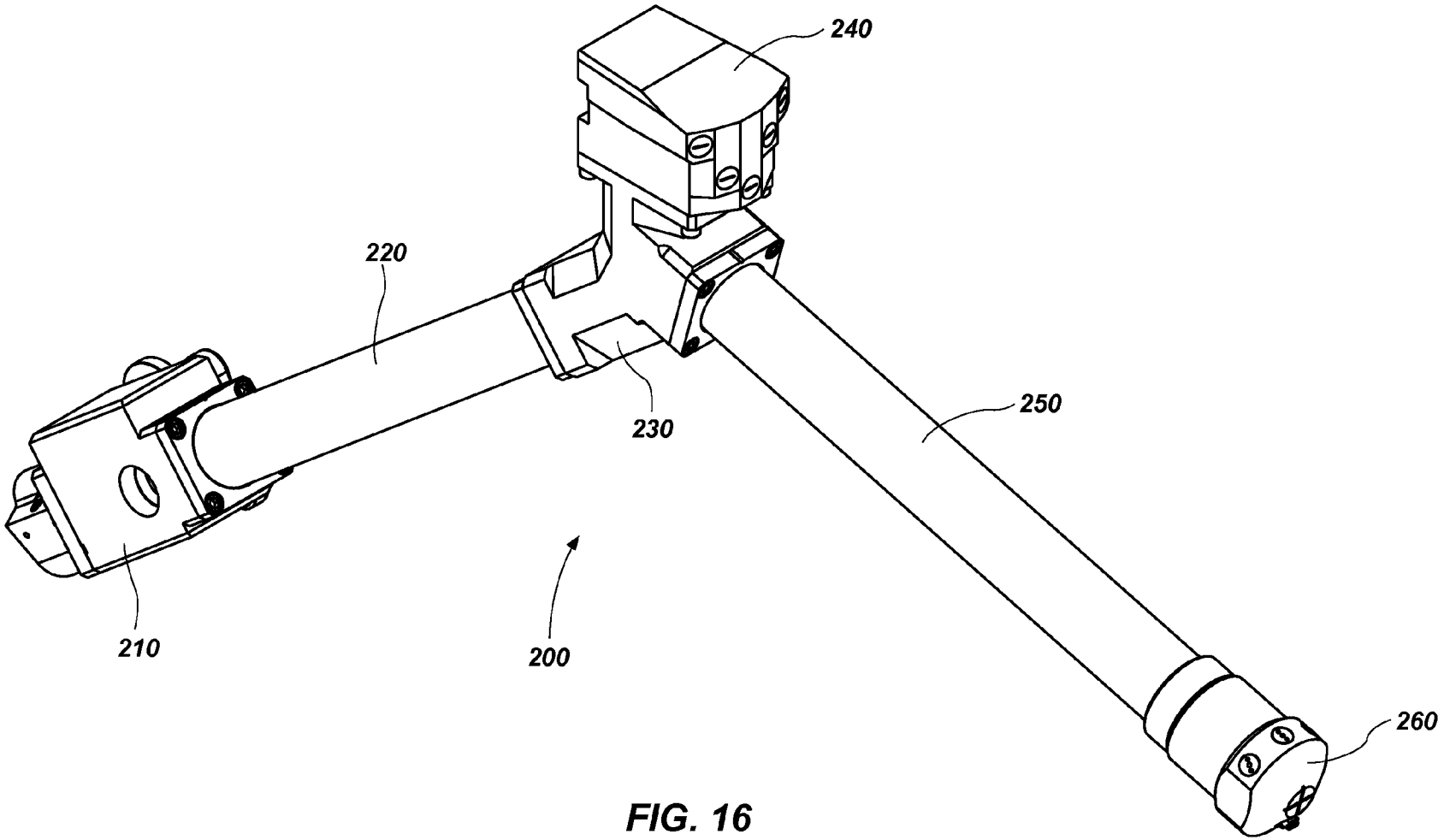
FIG. 16 is a perspective view of an embodiment of a four-step snowmaking gun with a modular dual vector fluid nozzle head, according to the present invention.
Figure 17B:
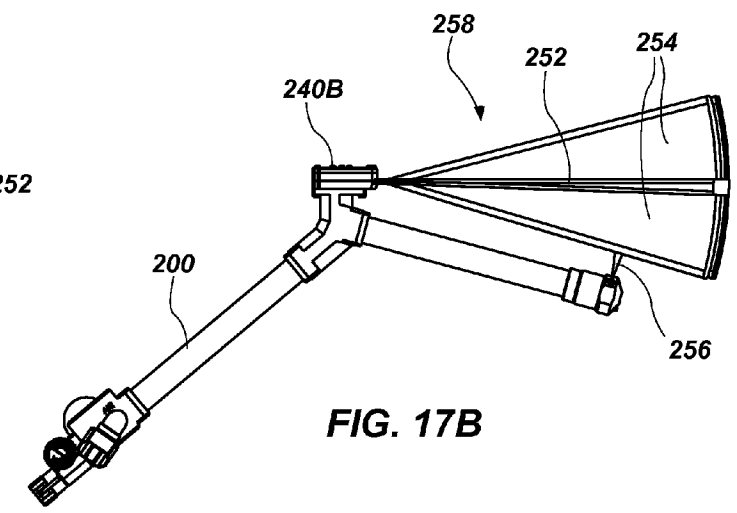
FIGS. 17A-17D are various perspective views of a composite dual vector spray pattern exiting the nozzle and interspersing with the ice nuclei jets from the nucleator head, according to the present invention.
Figure 17A:
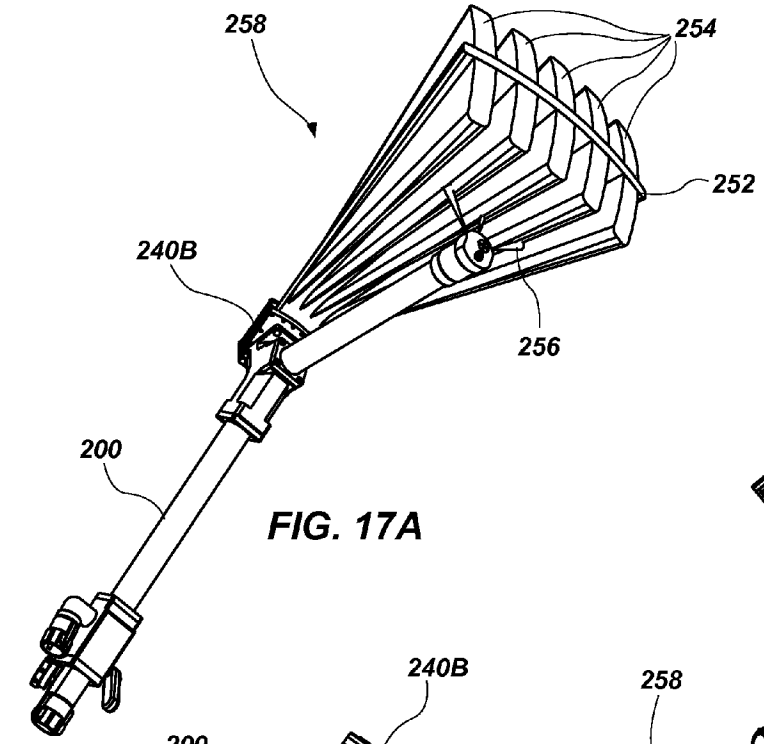
Figure 17D:
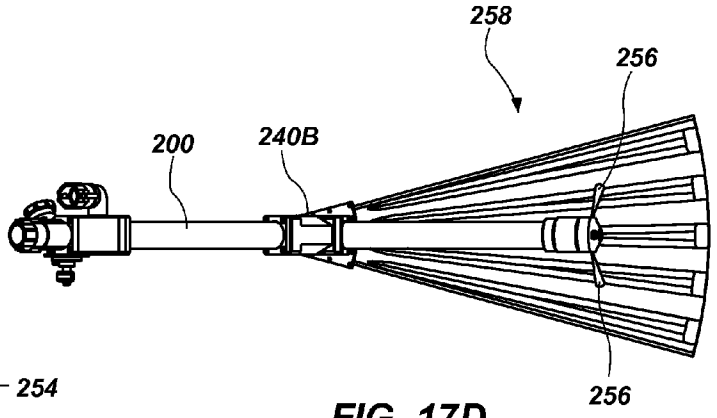
Figure 17C:
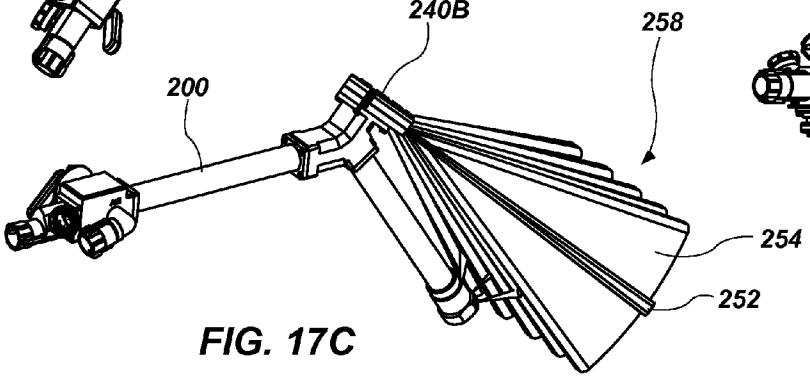
Figure 18B:
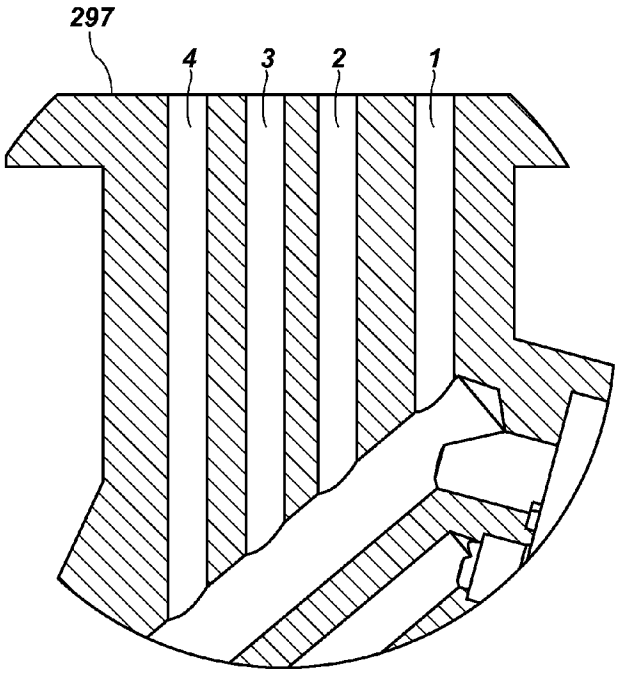
FIGS. 18A and 18B are cross-section views of a four-step nozzle manifold as shown in FIG. 16, according to the present invention.
Figure 18A:
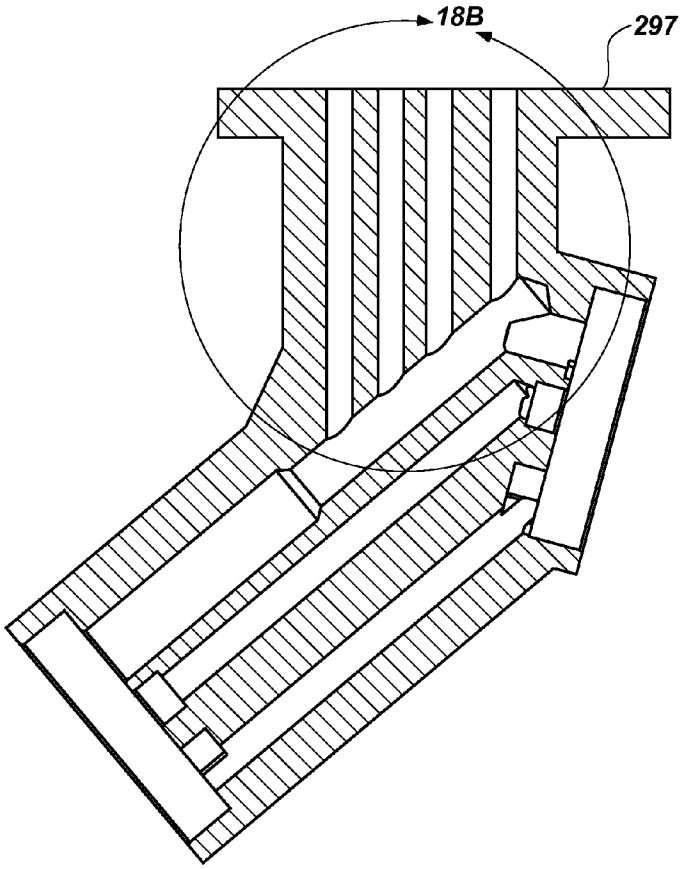

FIG. 16 is a perspective view of an embodiment of a four-step snowmaking gun, shown generally at arrow 200, with a modular dual vector fluid nozzle head 240, according to the present invention. The substantial components of a four-step gun 200 are shown in FIG. 16, namely a bottom manifold 210, connected to an elongated hollow main mast 220, which in turn is connected to a nozzle manifold 230. A four-step dual vector fluid nozzle 240 is connected to the nozzle manifold 230. Also connected to the nozzle manifold 230, are a nucleator mast 250 and nucleator nozzle head 260. Various cross-sections of an exemplary four-step nozzle manifold 230 are shown in FIGS. 18A and 18B which clearly show the four source channels (1-4) of water leading to a nozzle head mount 297.

FIGS. 17A-17D are various perspective views of a composite dual vector spray pattern, shown generally at arrow 258, exiting the a four-step low rise nozzle 240B and interspersing with the ice nuclei jets 256 from the nucleator head, according to the present invention. Note that the composite spray pattern has a plurality of vertically oriented components 254 and one central horizontal component 252.

Figure 19:
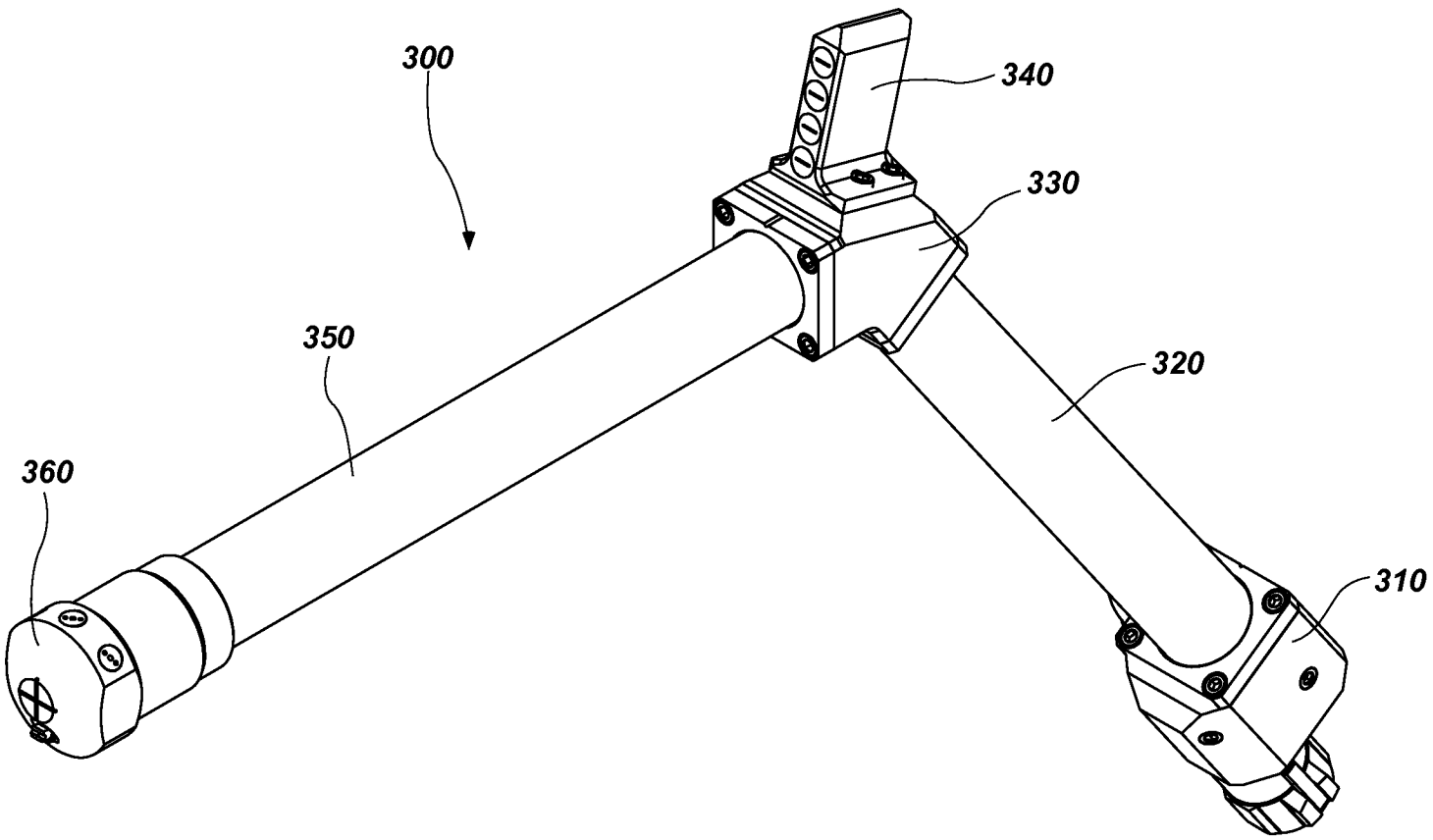
FIG. 19 is a perspective view of an embodiment of a single-step snowmaking gun with a linear modular dual vector fluid nozzle head, according to the present invention.

FIG. 19 is a perspective view of an embodiment of a single-step snowmaking gun 300 with a linear modular dual vector fluid nozzle head 340, according to the present invention. The substantial components of a single-step gun 300 are shown in FIG. 19, namely a bottom manifold 310, connected to an elongated hollow main mast 320, which in turn is connected to a nozzle manifold 330. A single-step modular dual vector fluid nozzle 340 is connected to the nozzle manifold 330. Also connected to the nozzle manifold 330, are a nucleator mast 350 and nucleator nozzle head 360. Gun 300 has only one step. It is either on or off. Gun 300 is much simpler mechanically because it does not require sophisticated valving.

Figure 20:
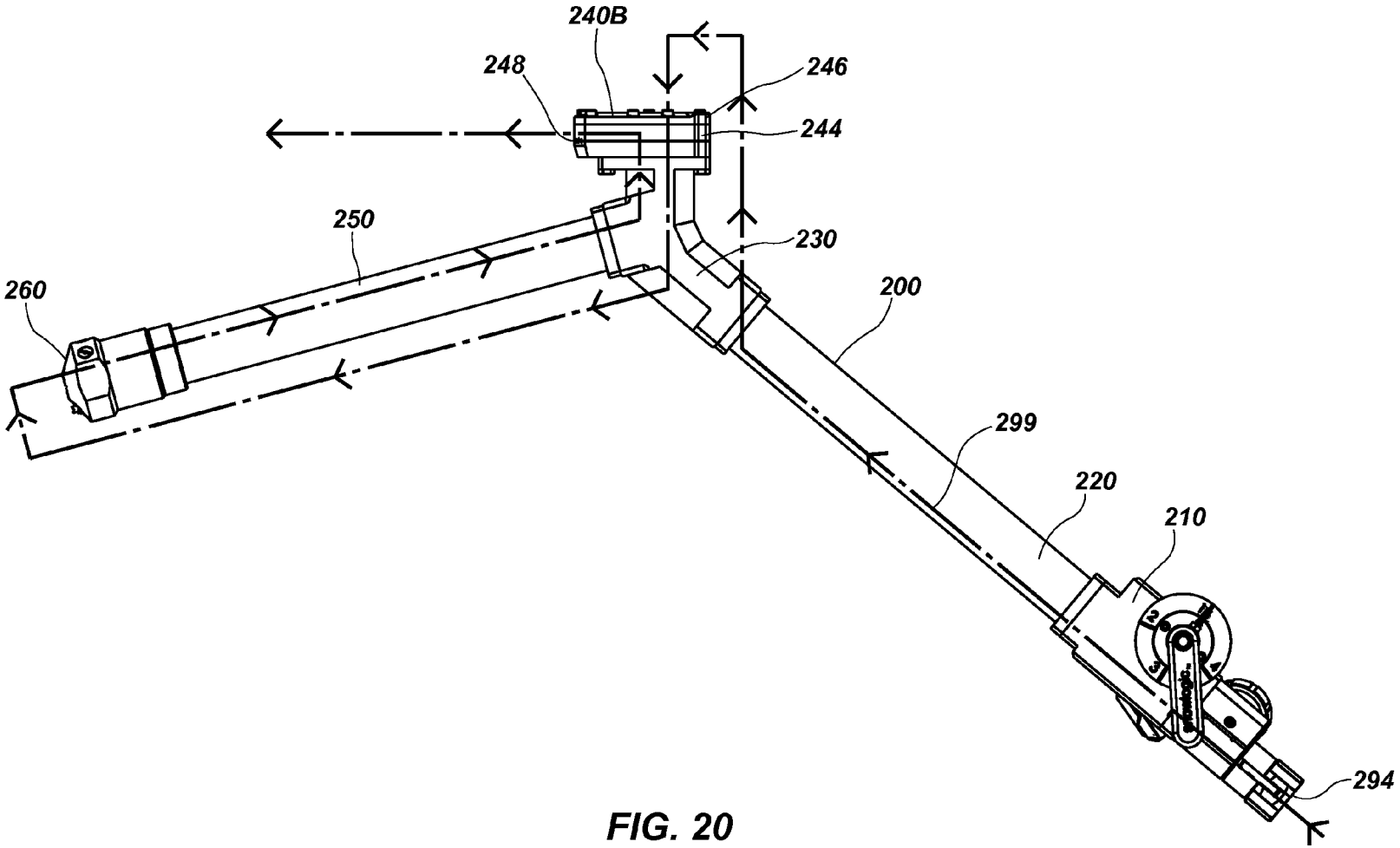
FIG. 20 is a simplified diagram of water flow through any of the single and multi-step snowmaking guns disclosed herein.

FIG. 20 is a simplified diagram of water flow through any of the single and multi-step snowmaking guns disclosed herein. The dot-dash arrow 299 shows the water path through an exemplary four-step gun 200. The water comes in through a water fixture in the bottom manifold 210 passes up through the main mast 220 up through the nozzle manifold and actually circulates between the top plate and the cover plate of the nozzle 240B before returning to the nozzle manifold 230 then out through the nucleator mast 250 to the nucleator head 260 to form ice nuclei and then returns to the nozzle 240B through the nucleator mast 250 before exiting the orifices 248. This pre-circulation through the nozzle 240B and out to the nucleator head 260 and back keeps the novel single and multi-step snowmaking guns 100, 200 and 300 of the present invention from freezing during operation. The water circulating keeps the component parts from freezing.

Having described the snow gun embodiments shown in the drawings along with their particular structural features and variations using particular terminology, additional embodiments of single and multi-step snow guns are disclosed below. The following embodiments of single and multi-step snow guns may or may not correspond precisely to the illustrated embodiments, but will have structural elements and features that are readily apparent based on the illustrated embodiments and description of the drawings as provided herein. Exemplary embodiments may be discussed in reference to these more general embodiments of single and multi-step snow guns.

An embodiment of a multi-step snowmaking gun is disclosed. This embodiment of a multi-step snowmaking gun may include a bottom manifold having fixtures for receiving pressurized water and compressed air. One embodiment of a bottom manifold is shown in FIGS. 1-9, which is a particular embodiment of a bottom manifold 110, which is configured for use with six-step gun 100. This embodiment of a multi-step snowmaking gun may further include an elongated hollow main mast connected to the bottom manifold. One embodiment of such an elongated hollow main mast is the embodiment of an elongated hollow main mast 120 shown in FIGS. 1-9, which is configured for use with six-step gun 100. This embodiment of a multi-step snowmaking gun may further include a nucleator head for generating atomized ice crystals from the pressurized water and the compressed air. One embodiment of such a nucleator head is shown in FIGS. 1-3 and 5-9, namely nucleator head 160, which is configured for use with six-step gun 100. This embodiment of a multi-step snowmaking gun may further include an elongated hollow nucleator mast connected to the nucleator head. One embodiment of such a nucleator mast is shown in FIGS. 1-3 and 5-9, namely nucleator mast 150, which is configured for use with six-step gun 100. This embodiment of a multi-step snowmaking gun may further include a multi-step fluid nozzle for generating atomized water jets from the pressurized water, the nozzle configured to be operated in discrete production levels measured in steps of atomized water droplet jet production. One embodiment of such a multi-step fluid nozzle is shown in FIGS. 1-9, namely six-step fluid nozzle 140, which is configured for use with six-step gun 100. Finally, this embodiment of a multi-step snowmaking gun may further include a nozzle manifold having a nozzle manifold body configured to mate with the elongated main mast, the elongated nucleator mast and the multi-step fluid nozzle. One embodiment of such a nozzle manifold is shown in FIGS. 1-9, namely nozzle manifold 130, which is configured for use with six-step gun 100.

According to another embodiment, the multi-step snowmaking gun may further include a plunger disposed within the nozzle manifold, the plunger configured to selectively open or close water valves leading to the multi-step fluid nozzle in serial order. One embodiment of a snowmaking gun includes a bottom manifold having a rack and pinion system for driving the plunger.

According to yet another embodiment of a multi-step snowmaking gun, the bottom manifold may include controls for adjusting the pressurized water and the compressed air delivered to the main mast. According to yet another embodiment of a multi-step snowmaking gun, the nozzle manifold may be configured to receive the pressurized water and the compressed air from the main mast and deliver pressurized water to the multi-step fluid nozzle. According to yet another embodiment of a multi-step snowmaking gun, the nozzle manifold may further be configured to deliver the pressurized water and the compressed air to the nucleator mast.

According to one embodiment of a multi-step snowmaking gun, the nozzle manifold further include a nozzle head extension block configured to selectively adjust a distance between the multi-step fluid nozzle and the nozzle manifold body, or an angle between a fluid jet spray and an axis of the nucleator mast. It will be understood that the extension block 132 as shown in FIGS. 1-4 can be used to flexibly interface almost any kind of nozzle.

According to a particular embodiment of a multi-step snowmaking gun, the multi-step fluid nozzle may include a six-step dual vector fluid nozzle having six independent fluid chambers, each of the six independent fluid chambers including an independent intake port for selectively and independently receiving pressurized water from the nozzle manifold and expelling atomized mists of water particles through exit orifices connected to each of the six independent fluid chambers. According to another embodiment of a multi-step snowmaking gun, the multi-step fluid nozzle may include a six-step dual vector fluid nozzle having six steps of production ranging from only one of the six independent fluid chambers, serially up to all six of the six independent fluid chambers being charged with pressurized water.

According to a particular embodiment of a multi-step snowmaking gun, the multi-step fluid nozzle may include a four-step dual vector fluid nozzle having four independent fluid chambers, each of the four independent fluid chambers including an independent intake port for selectively and independently receiving pressurized water from the nozzle manifold and expelling atomized mists of water particles through exit orifices connected to each of the four independent fluid chambers. According to another embodiment of a multi-step snowmaking gun, the multi-step fluid nozzle may include a four-step dual vector fluid nozzle having four steps of production ranging from only one of the four independent fluid chambers, serially up to all four of the four independent fluid chambers being charged with pressurized water.

According to one embodiment of a multi-step snowmaking gun, the multi-step fluid nozzle may include a single-step dual vector fluid nozzle having one independent fluid chamber including an independent intake port for selectively and independently receiving pressurized water from the nozzle manifold and expelling atomized mists of water particles through exit orifices connected to the independent fluid chamber. According to a particular embodiment of a multi-step snowmaking gun, the multi-step fluid nozzle may include a single-step dual vector fluid nozzle having a single step of production.

Another embodiment of a multi-step snowmaking gun is disclosed. This embodiment of a multi-step snowmaking gun may include a bottom manifold having fixtures for receiving pressurized water and compressed air. This embodiment of a multi-step snowmaking gun may further include a nozzle manifold having a nozzle manifold body configured for receiving and delivering the pressurized water and the compressed air. This embodiment of a multi-step snowmaking gun may further include an elongated hollow main mast connected between the bottom manifold and the nozzle manifold for delivering the pressurized water and the compressed air from the bottom manifold to the nozzle manifold. This embodiment of a multi-step snowmaking gun may further include a multi-step fluid nozzle connected to the nozzle manifold for receiving the pressurized water and generating and expelling atomized water jets into the atmosphere. This embodiment of a multi-step snowmaking gun may further include an elongated hollow nucleator mast connected to the nozzle manifold and configured for receiving and delivering the pressurized water and the compressed air. Finally, this embodiment of a multi-step snowmaking gun may further include a nucleator head connected to the nucleator mast configured for receiving the pressurized water and the compressed air and generating atomized ice crystals from the pressurized water and the compressed air for expelling into the atmosphere in the path of the water jets, thereby generating artificial snow under selected atmospheric conditions.

According to one embodiment, the multi-step snowmaking gun may further include a plunger disposed within the nozzle manifold and configured to selectively open or close water valves leading to the multi-step fluid nozzle in serial order. According to a particular embodiment of a multi-step snowmaking gun, the bottom manifold may further include a rack and pinion system for driving the plunger. According to another embodiment of a multi-step snowmaking gun, the bottom manifold may further include controls for adjusting the pressurized water and the compressed air delivered to the main mast. According to yet another embodiment of a multi-step snowmaking gun, the bottom manifold may further include valves for controlling flow of the pressurized water and the compressed air delivered to the multi-step fluid nozzle and the nucleator head.

According to one embodiment of a multi-step snowmaking gun, the nozzle manifold further comprises a nozzle head extension block configured to selectively adjust a distance between the multi-step fluid nozzle and the nozzle manifold body, or an angle between a fluid jet spray and an axis of the nucleator mast.

According to another embodiment of a multi-step snowmaking gun, the multi-step fluid nozzle may include six steps of atomized water droplet jet production ranging from only one of the six independent fluid chambers up to all six of the independent fluid chambers being charged with pressurized water, each of the six steps including an independent fluid chamber, each of the independent fluid chambers including an independent intake port for selectively and independently receiving pressurized water from the nozzle manifold and expelling atomized mists of water particles through exit orifices connected to the independent fluid chamber as composite dual vector water jets, the composite dual vector water jets having distinctive horizontal and vertical components in a resulting spray pattern.

According to another embodiment of a multi-step snowmaking gun the multi-step fluid nozzle may include four steps of atomized water droplet jet production ranging from only one of the four independent fluid chambers up to all four of the independent fluid chambers being charged with pressurized water, each of the four steps including an independent fluid chamber, each of the independent fluid chambers including an independent intake port for selectively and independently receiving pressurized water from the nozzle manifold and expelling atomized mists of water particles through exit orifices connected to the independent fluid chamber as composite dual vector water jets, the composite dual vector water jets having distinctive horizontal and vertical components in a resulting spray pattern.

According to yet another embodiment of a multi-step snowmaking gun, the multi-step fluid nozzle may include a single step of atomized water droplet jet production using an independent fluid chamber connected to an intake port for receiving pressurized water from the nozzle manifold and expelling atomized mists of water particles through exit orifices connected to the fluid chamber as composite dual vector water jets, the composite dual vector water jets having distinctive horizontal and vertical components in a resulting spray pattern.

Another embodiment of a multi-step snowmaking gun is disclosed. This embodiment of a multi-step snowmaking gun may include a bottom manifold having fixtures for receiving pressurized water and compressed air, the bottom manifold further comprising a first end main mast receptacle. This embodiment of a multi-step snowmaking gun may further include a nozzle manifold having a second end main mast receptacle, a nozzle receptacle and a first end nucleator mast receptacle, the nozzle manifold further configured for receiving the pressurized water and the compressed air, delivering the pressurized water to the nozzle receptacle and to the first end nucleator mast receptacle. This embodiment of a multi-step snowmaking gun may further include an elongated hollow main mast having a main mast first end connected to the first end main mast receptacle of the bottom manifold, and having a main mast second end connected to the second end main mast receptacle of the nozzle manifold for delivering the pressurized water and the compressed air from the bottom manifold to the nozzle manifold. This embodiment of a multi-step snowmaking gun may further include a multi-step water nozzle connected to the nozzle receptacle of the nozzle manifold, the nozzle configured for receiving the pressurized water and generating and expelling atomized water jets into the atmosphere as composite dual vector water jets, the composite dual vector water jets having distinctive horizontal and vertical components in a resulting spray pattern. This embodiment of a multi-step snowmaking gun may further include an elongated hollow nucleator mast having a nucleator mast first end and a nucleator mast second end, wherein the nucleator mast first end is connected to the first end nucleator mast receptacle of the nozzle manifold and configured for receiving and delivering the pressurized water and the compressed air to the nucleator mast second end. Finally, this embodiment of a multi-step snowmaking gun may further include a nucleator head connected to the nucleator mast second end of the nucleator mast, the nucleator head configured for receiving the pressurized water and the compressed air and generating atomized ice crystals from the pressurized water in combination with the compressed air for expelling the atomized ice crystals into the atmosphere in the path of the water jets, thereby seeding snowflakes and generating artificial snow under selected atmospheric conditions.

According to one embodiment of a multi-step snowmaking gun, the multi-step water nozzle may be selected from the group consisting of: a six-step water nozzle, a four-step water nozzle and a single-step water nozzle.

The embodiments of single and multi-step snow guns disclosed herein and their components may be formed of any suitable materials, such as aluminum, copper, stainless steel, titanium, carbon fiber composite materials and the like. The component parts may be manufactured according to methods known to those of ordinary skill in the art, including by way of example only, machining and investment casting. Assembly and finishing of nozzles according to the description herein is also within the knowledge of one of ordinary skill in the art and, thus, will not be further elaborated herein.

In understanding the scope of the present invention, the term "fluid channel" is used to describe a three-dimensional space disposed within a cylindrical housing that begins at a fluid intake port and ends at an orifice. In understanding the scope of the present invention, the term "fluid chamber" is used herein synonymously with the term "fluid channel". In understanding the scope of the present invention, the term "configured" as used herein to describe a component, section or part of a device may include any suitable mechanical hardware that is constructed or enabled to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part", "section", "portion", "member", or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions relative to the front of an embodiment of a nozzle that has an orifice as described herein. Finally, terms of degree such as "substantially", "about" and "approximately" as used herein mean a reasonable amount of deviation of the modified term such that the end result is not significantly changed.

While the foregoing features of the present invention are manifested in the detailed description and illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A multi-step snowmaking gun, comprising:

a bottom manifold having fixtures for receiving pressurized water and compressed air;

an elongated hollow main mast connected to the bottom manifold;

a nucleator head for generating atomized ice crystals from the pressurized water and the compressed air;

an elongated hollow nucleator mast connected to the nucleator head;

a four-step fluid nozzle for generating atomized water jets from the pressurized water, the nozzle configured to be operated in discrete production levels measured in steps of atomized water droplet jet production, wherein the four-step fluid nozzle comprises four independent fluid chambers, each of the four independent fluid chambers including an independent intake port for selectively and independently receiving pressurized water from the nozzle manifold and expelling atomized mists of water particles through exit orifices connected to each of the four independent fluid chambers, the four-step fluid nozzle further comprising four steps of production ranging from only one of the four independent fluid chambers, serially up to all four of the four independent fluid chambers being charged with pressurized water; and a nozzle manifold having a nozzle manifold body configured to mate with the elongated main mast, the elongated nucleator mast and the four-step fluid nozzle.

2. The snowmaking gun according to claim 1, further comprising a plunger disposed within the nozzle manifold, the plunger configured to selectively open or close water valves leading to the four-step fluid nozzle in serial order.

3. The snowmaking gun according to claim 2, wherein the bottom manifold further comprises a rack and pinion system for driving the plunger.

4. The snowmaking gun according to claim 1, wherein the bottom manifold further comprises controls for adjusting the pressurized water and the compressed air delivered to the main mast.

5. The snowmaking gun according to claim 1, wherein the nozzle manifold is configured to receive the pressurized water and the compressed air from the main mast and deliver pressurized water to the four-step fluid nozzle.

6. The snowmaking gun according to claim 5, wherein the nozzle manifold is further configured to deliver the pressurized water and the compressed air to the nucleator mast.

7. The snowmaking gun according to claim 1, wherein the nozzle manifold further comprises a nozzle head extension block configured to selectively adjust a distance between the four-step fluid nozzle and the nozzle manifold body, or an angle between a fluid jet spray and an axis of the nucleator mast.

8. A multi-step snowmaking gun, comprising:

a bottom manifold having fixtures for receiving pressurized water and compressed air;

a nozzle manifold having a nozzle manifold body configured for receiving and delivering the pressurized water and the compressed air, wherein the nozzle manifold further comprises a nozzle head extension block configured to selectively adjust a distance between the multi-step fluid nozzle and the nozzle manifold body, or an angle between a fluid jet spray and an axis of the nucleator mast;

an elongated hollow main mast connected between the bottom manifold and the nozzle manifold for delivering the pressurized water and the compressed air from the bottom manifold to the nozzle manifold;

a multi-step fluid nozzle connected to the nozzle manifold for receiving the pressurized water and generating and expelling atomized water jets into the atmosphere;

an elongated hollow nucleator mast connected to the nozzle manifold and configured for receiving and delivering the pressurized water and the compressed air; and a nucleator head connected to the nucleator mast configured for receiving the pressurized water and the compressed air and generating atomized ice crystals from the pressurized water and the compressed air for expelling into the atmosphere in the path of the water jets, thereby generating artificial snow under selected atmospheric conditions.

9. The snowmaking gun according to claim 8, further comprising a plunger disposed within the nozzle manifold and configured to selectively open or close water valves leading to the multi-step fluid nozzle in serial order.

10. The snowmaking gun according to claim 9, wherein the bottom manifold further comprises a rack and pinion system for driving the plunger.

11. The snowmaking gun according to claim 8, wherein the bottom manifold further comprises controls for adjusting the pressurized water and the compressed air delivered to the main mast.

12. The snowmaking gun according to claim 8, wherein the bottom manifold further comprises valves for controlling flow of the pressurized water and the compressed air delivered to the multi-step fluid nozzle and the nucleator head.

13. The snowmaking gun according to claim 8, wherein the multi-step fluid nozzle comprises six steps of atomized water droplet jet production ranging from only one of the six independent fluid chambers up to all six of the independent fluid chambers being charged with pressurized water, each of the six steps including an independent fluid chamber, each of the independent fluid chambers including an independent intake port for selectively and independently receiving pressurized water from the nozzle manifold and expelling atomized mists of water particles through exit orifices connected to the independent fluid chamber as composite dual vector water jets, the composite dual vector water jets having distinctive horizontal and vertical components in a resulting spray pattern.

14. The snowmaking gun according to claim 8, wherein the multi-step fluid nozzle comprises four steps of atomized water droplet jet production ranging from only one of the four independent fluid chambers up to all four of the independent fluid chambers being charged with pressurized water, each of the four steps including an independent fluid chamber, each of the independent fluid chambers including an independent intake port for selectively and independently receiving pressurized water from the nozzle manifold and expelling atomized mists of water particles through exit orifices connected to the independent fluid chamber as composite dual vector water jets, the composite dual vector water jets having distinctive horizontal and vertical components in a resulting spray pattern.

15. The snowmaking gun according to claim 8, wherein the multi-step fluid nozzle comprises a single step of atomized water droplet jet production using an independent fluid chamber connected to an intake port for receiving pressurized water from the nozzle manifold and expelling atomized mists of water particles through exit orifices connected to the fluid chamber as composite dual vector water jets, the composite dual vector water jets having distinctive horizontal and vertical components in a resulting spray pattern.

16. A multi-step snowmaking gun, comprising:

a bottom manifold having fixtures for receiving pressurized water and compressed air, the bottom manifold further comprising a first end main mast receptacle;

a nozzle manifold having a second end main mast receptacle, a nozzle receptacle and a first end nucleator mast receptacle, the nozzle manifold further configured for receiving the pressurized water and the compressed air, delivering the pressurized water to the nozzle receptacle and to the first end nucleator mast receptacle;

an elongated hollow main mast having a main mast first end connected to the first end main mast receptacle of the bottom manifold, and having a main mast second end connected to the second end main mast receptacle of the nozzle manifold for delivering the pressurized water and the compressed air from the bottom manifold to the nozzle manifold;

a multi-step water nozzle connected to the nozzle receptacle of the nozzle manifold, the nozzle configured for receiving the pressurized water and generating and expelling atomized water jets into the atmosphere as composite dual vector water jets, the composite dual vector water jets having distinctive horizontal and vertical components in a resulting spray pattern;

an elongated hollow nucleator mast having a nucleator mast first end and a nucleator mast second end, wherein the nucleator mast first end is connected to the first end nucleator mast receptacle of the nozzle manifold and configured for receiving and delivering the pressurized water and the compressed air to the nucleator mast second end; and a nucleator head connected to the nucleator mast second end of the nucleator mast, the nucleator head configured for receiving the pressurized water and the compressed air and generating atomized ice crystals from the pressurized water in combination with the compressed air for expelling the atomized ice crystals into the atmosphere in the path of the water jets, thereby seeding snowflakes and generating artificial snow under selected atmospheric conditions.

17. The snowmaking gun according to claim 16, wherein the multi-step water nozzle is selected from the group consisting of: a six-step water nozzle, a four-step water nozzle and a single-step water nozzle.

18. A multi-step snowmaking gun, comprising:

a bottom manifold having fixtures for receiving pressurized water and compressed air;

an elongated hollow main mast connected to the bottom manifold;

a nucleator head for generating atomized ice crystals from the pressurized water and the compressed air;

an elongated hollow nucleator mast connected to the nucleator head;

a six-step fluid nozzle for generating atomized water jets from the pressurized water, the nozzle configured to be operated in discrete production levels measured in steps of atomized water droplet jet production, wherein the six-step fluid nozzle comprises six independent fluid chambers, each of the six independent fluid chambers including an independent intake port for selectively and independently receiving pressurized water from the nozzle manifold and expelling atomized mists of water particles through exit orifices connected to each of the six independent fluid chambers, the six-step fluid nozzle further comprising six steps of production ranging from only one of the six independent fluid chambers, serially up to all six of the six independent fluid chambers being charged with pressurized water; and a nozzle manifold having a nozzle manifold body configured to mate with the elongated main mast, the elongated nucleator mast and the six-step fluid nozzle.

19. The snowmaking gun according to claim 18, further comprising a plunger disposed within the nozzle manifold, the plunger configured to selectively open or close water valves leading to the six-step fluid nozzle in serial order.

20. The snowmaking gun according to claim 19, wherein the bottom manifold further comprises a rack and pinion system for driving the plunger.

21. The snowmaking gun according to claim 18, wherein the bottom manifold further comprises controls for adjusting the pressurized water and the compressed air delivered to the main mast.

22. The snowmaking gun according to claim 18, wherein the nozzle manifold is configured to receive the pressurized water and the compressed air from the main mast and deliver pressurized water to the six-step fluid nozzle.

23. The snowmaking gun according to claim 22, wherein the nozzle manifold is further configured to deliver the pressurized water and the compressed air to the nucleator mast.

24. The snowmaking gun according to claim 18, wherein the nozzle manifold further comprises a nozzle head extension block configured to selectively adjust a distance between the six-step fluid nozzle and the nozzle manifold body, or an angle between a fluid jet spray and an axis of the nucleator mast.

* * * * *